United States Patent [19]

Hirano et al.

[11] Patent Number: 4,607,006

[45] Date of Patent: Aug. 19, 1986

[54] SILVER HALIDE PHOTOGRAPHIC LIGHT-SENSITIVE MATERIAL CONTAINING NON-SPECTRAL SENSITIZING ELECTRON DONATIVE SILVER HALIDE ADSORPTIVE COMPOUND

[75] Inventors: Shigeo Hirano, Kanagawa; Yasuhisa Sano, Shizuoka; Haruo Takei, Kanagawa; Tsutomu Miyasaka, Kanagawa; Shinsaku Fujita, Kanagawa, all of Japan

[73] Assignee: Fuji Photo Film Co., Ltd., Kanagawa, Japan

[21] Appl. No.: 658,955

[22] Filed: Oct. 9, 1984

[30] Foreign Application Priority Data

Oct. 6, 1983 [JP] Japan ..... 58-187404.

[51] Int. Cl.[4] ..... G03C 1/02; G03C 1/06; G03C 1/08

[52] U.S. Cl. ..... 430/572; 430/573; 430/576; 430/599; 430/600; 430/602; 430/603; 430/604; 430/605

[58] Field of Search ..... 430/576, 572, 573, 599, 430/600, 603, 602, 604, 605

[56] References Cited

U.S. PATENT DOCUMENTS

| | | | |
|---|---|---|---|
| 3,457,078 | 7/1969 | Riester | 430/576 |
| 3,592,656 | 7/1971 | Brooks | 430/572 X |
| 3,615,633 | 10/1971 | Brooks | 430/576 X |
| 3,669,672 | 6/1972 | Shiba et al. | 430/576 |
| 3,776,738 | 12/1973 | Ohlschlager et al. | 430/599 X |
| 3,954,481 | 5/1976 | Ohlschlager et al. | 430/572 |
| 3,994,733 | 11/1976 | Hinata et al. | 430/576 X |
| 4,002,480 | 1/1977 | Hinata et al. | 430/572 X |
| 4,515,888 | 5/1985 | Beretta et al. | 430/576 X |

FOREIGN PATENT DOCUMENTS

| | | | |
|---|---|---|---|
| 868797 | 5/1961 | United Kingdom | 430/572 |
| 2034908 | 6/1980 | United Kingdom | 430/599 |

*Primary Examiner*—John E. Kittle
*Assistant Examiner*—Mukund J. Shah
*Attorney, Agent, or Firm*—Sughrue, Mion, Zinn, Macpeak, and Seas

[57] ABSTRACT

A silver halide photographic light-sensitive material is described containing at least one electron-donative, silver halide-adsorptive compound represented by the following general formula (A) or (B), which is not a spectral sensitizing agent for silver halide or a nucleating agent:

D—L—X (A)

D—X (B)

wherein D represents an electron donative atomic group comprising an aromatic ring or hetero ring, which may be unsubstituted or substituted with at least one substituent; L represents a linkage group containing at least one of C, N, S or O; and X represents a group which is adsorptive with a silver halide-adsorptive group containing at least one of C, N, S, O or Se, said N being optionally quarternized.

28 Claims, No Drawings

SILVER HALIDE PHOTOGRAPHIC LIGHT-SENSITIVE MATERIAL CONTAINING NON-SPECTRAL SENSITIZING ELECTRON DONATIVE SILVER HALIDE ADSORPTIVE COMPOUND

FIELD OF THE INVENTION

This invention relates to a silver halide light-sensitive material having improved photographic properties, particularly, enhanced photographic sensitivity.

BACKGROUND OF THE INVENTION

In the field of silver halide photographic light-sensitive materials (particularly photographic emulsions), techniques are required for more effectively enhancing the photographic sensitivity of light-sensitive materials.

Chemical sensitizing agents conventionally have been added to photographic emulsions to enhance the intrinsic sensitivity of silver halide, for example, by gold sensitization, and group VIII metal sensitization.

Further, various spectral sensitizing agents (for example, methine sensitizing dyes) have been added, alone or in combination, to emulsions for imparting spectral sensitivity in a desired wavelength region to silver halide.

It is also known to super-additively enhance spectral sensitivity by using a certain spectral sensitizing dye in combination with another spectral sensitizing dye or a colorless compound which itself does not have a spectral sensitizing effect (i.e., "supersensitization").

Examples of colorless compounds having a supersensitizing effect include sulfonic acid derivatives (described in U.S. Pat. Nos. 2,937,089 and 3,706,567), heterocyclic compounds (described in U.S. Pat. No. 3,615,613, Japanese Patent Publication No. 38408/73, U.S. Pat. No. 3,592,656, Japanese Patent Application (OPI) No. 81613/76 (U.S. Pat. No. 4,030,927) (the term "OPI" as used herein refers to a "published unexamined Japanese patent application"), U.S. Pat. Nos. 3,592,654 and 3,615,633, Japanese Patent Application (OPI) Nos. 90323/75 and 104927/75), sulfur-containing compounds (described in U.S. Pat. No. 3,457,078, Japanese Patent Application (OPI) No. 77224/76 (U.S. Pat. No. 4,097,284), U.S. Pat. Nos. 3,458,318, 3,954,481, 3,506,443 and 4,232,118, German Pat. No. 1,447,577), quaternary ammonium salts (described in U.S. Pat. Nos. 2,271,623, 3,481,742 and 2,860,982), and polycyclic aromatic compounds (described in U.S. Pat. No. 3,575,869). However, some of these compounds have the undesirable effect of deteriorating the stability of the emulsion or increasing fog, and most of them have the disadvantage that their supersensitization effect is small.

SUMMARY OF THE INVENTION

An object of the present invention is to provide a silver halide photographic light-sensitive material containing an additive capable of more effectively enhacing the spectral sensitivity of the light-sensitive material.

Another object of the present invention is to provide supersensitizing agents which do not adversely affect the stability of the photographic emulsion.

As a result of intensive investigations, the inventors have found that these and other objects of the present invention can be effectively attained by incorporating in a silver halide photographic light-sensitive material at least one silver halide-adsorptive, electron-donative compound represented by the following general formula (A) or (B) which is not a spectral sensitizing agent for silver halide or a nucleating agent:

$$D—L—X \quad (A)$$

$$D—X \quad (B)$$

wherein D represents an electron-donative atomic group comprising an aromatic ring or hetero ring which may be unsubstituted or substituted with at least one substituent; L represents a linkage group containing at least one of C, N, S or O; and X represents a silver halide-adsorptive group containing at least one of C, N, S, O or Se, N being optionally quaternized.

DETAILED DESCRIPTION OF THE INVENTION

Because compounds represented by the general formula (A) or (B) do not have a spectral sensitizing effect, and because they are physically and chemically different from conventionally known supersensitizing agents (i.e., they are not spectral sensitizing dyes), it is quite surprizing that these compounds function as supersensitizing agents.

When the present invention is used in the diffusion transfer process, the unexpected result is also obtained that processing temperature dependence is depressed.

In the above formulae, the electron-donative aromatic ring or hetero ring represented by D may be a single ring or a fused ring system between aromatic rings, between hetero rings, or between an aromatic ring and a hetero ring. The number of fused rings in such a system may be, for example, about 2 to 6. The hetero ring contains at least one of N, O, S or Se as a hetero atom. The aromatic or hetero ring is preferably a 5- or 6-membered ring. The ring represented by D may be derived from a metal salt or a metal complex. The metal may be selected from transition metals. Preferred examples of the metal include Ni, Co, Cu, Fe, Pt, Rh and Zn.

The linkage group represented by L is preferably an organic linkage group which acts to inhibit the formation of a $\pi$-conjugation system between D and X. Preferred examples of the linkage group include an alkylene group, an alkenylene group, an arylene group, a divalent group derived from hetero ring, —O—, —S—, —CO—, —$SO_2$—, —NH—, and —N= (these being optionally substituted) alone or in combination. When the arylene group, the alkenylene group or the divalent group derived from hetero ring itself forms the $\pi$-conjugation system, it is used in combination with the other group not forming the $\pi$-conjugation system. Examples of the divalent group derived from hetero ring include divalent groups derived from 5- or 6-membered hetero ring compounds containing at least one of N, S or O as a hetero atom, for example, pyridine, thiophene, furan, pyrazole, oxazole, thiazole, thiadiazole and triazole.

In the silver halide-adsorptive group represented by X, S, N and Se atoms contained in X act as an adsorptive atom.

X is preferably a group derived from, for example, the following compounds: thioureas, selenoureas, thioamides, mercapto-substituted hetero ring compounds (e.g., mercaptotetrazole, mercaptotriazole, mercaptothiadiazole, mercaptoimidazole, mercaptooxadiazole, mercaptothiazole, mercaptobenzimidazole, mercaptobenzothiazole, mercaptobenzoxazole, mercaptopyrimidine, mercaptotriazine, etc.), benzotriazoles, thiosemicarbazides, rhodanines, thiohydantoins, and thiobarbituric acid. Further, X may be derived from a group containing quaternized N, for example, a group derived from benzothiazole, benzimidazole, benzoxazole, benzoselenazole, thiazole, oxazole, selenazole, imidazole, pyridine or quinoline, wherein the nitrogen atom is quaternized. The quaternization of the nitrogen atom can be easily conducted by a conventional method. For example, a method of synthesizing spectral sensitizing dyes as described hereinafter can be utilized. Furthermore, X may be a simple mercapto group.

Preferred examples of X include a mercapto group and groups derived from thioureas, thioamides, thiosemicarbazides, and mercapto-substituted hetero ring compounds.

More preferred examples include groups derived from thioureas, thiosemicarbazides, and mercaptothiazoles, with those derived from thioureas being most preferred.

Examples of the groups derived from thioureas include those represented by the following general formula:

$$-NR_1\underset{\underset{S}{\|}}{C}NR_2R_3$$

wherein $R_1$, $R_2$ and $R_3$, which may be the same or different, each represents an alkyl group having preferably about 1 to 20, more preferably about 1 to 12, carbon atoms (e.g., a methyl group or an ethyl group), an aryl group having preferably about 6 to 20, more preferably about 6 to 10, carbon atoms (e.g., a phenyl group or a naphthyl group), or a hetero ring group (e.g., a 5-, 6- or 7-membered ring containing N, O, S, Se or the like as a hetero atom), with at least one of $R_1$, $R_2$ and $R_3$ being a hydrogen atom.

The groups represented by $R_1$ to $R_3$ may further be substituted. Substituents for the aryl or hetero ring group can include a halogen atom, an alkyl group having preferably about 1 to 12 carbon atoms, an alkoxy group having preferably about 1 to 12 carbon atoms, an acylamino group having preferably about 2 to 13 carbon atoms, an acyloxy group having preferably about 2 to 13 carbon atoms, and a sulfonylamino group, and substituents for the alkyl group include a halogen atom, an alkoxy group having preferably about 1 to 12 carbon atoms, an alkoxycarbonyl group having preferably about 2 to 13 carbon atoms, an alkylthio group having preferably about 1 to 12 carbon atoms, an amino group, and a cyano group.

Specific skeletons of electron donative atomic groups represented by D are as follows, in which D includes these skeletons, although the present invention is not to be construed as being limited thereto.

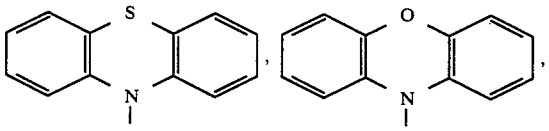

-continued

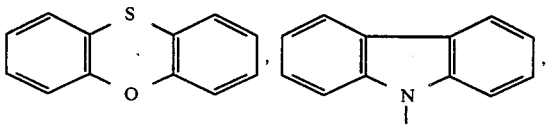

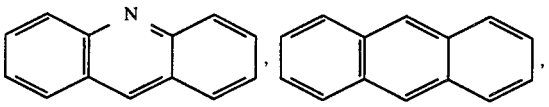

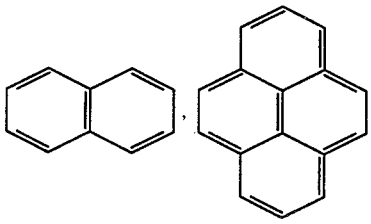

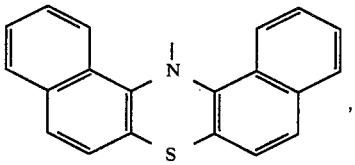

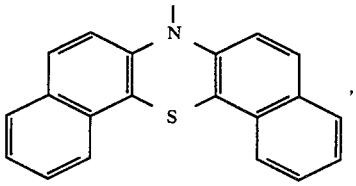

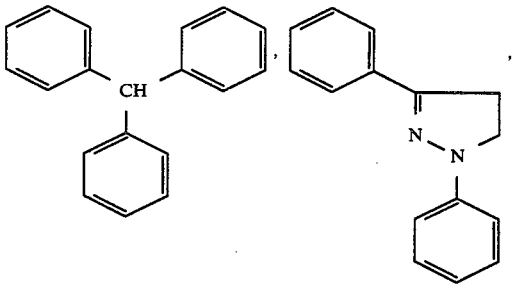

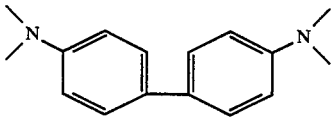

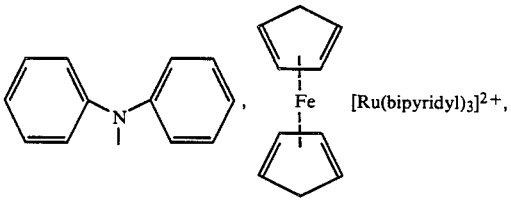

-continued

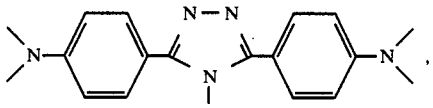

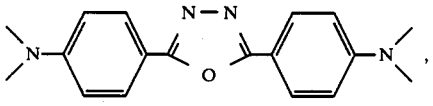

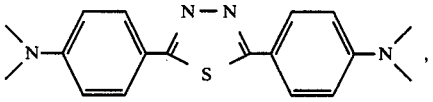

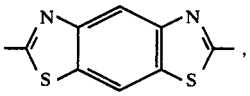

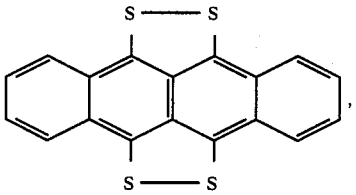

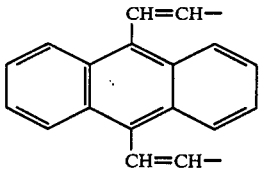

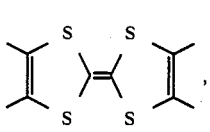

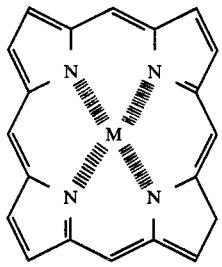

(In the above formula, M represents a transition metal such as Zn, Pd, Cu, Ni or Fe.)

Of these electron-donative skeletons contained in D, phenothiazine, phenoxazine, carbazole, and dibenzophenothiazine are preferred, and phenothiazine and dibenzophenothiazine are most preferred.

The above-illustrated electron-donative skeletons may be substituted by the following substituents (which may further be substituted): an amino group, an alkoxy group having preferably about 1 to 12 carbon atoms, a hydroxy group, an alkyl group having preferably about 1 to 12 carbon atoms, an aryl group having preferably about 6 to 20 carbon atoms, an aryloxy group having preferably about 6 to 20 carbon atoms, an alkylthio group having preferably about 1 to 12 carbon atoms, an arylthio group having preferably about 6 to 20 carbon atoms, a halogen atom, an acylamino group having preferably about 2 to 13 carbon atoms, an acyloxy group having preferably about 2 to 13 carbon atoms, a sulfonylamino group, a carbamoyl group, a sulfamoyl group, an alkoxycarbonyl group having preferably about 2 to 13 carbon atoms, a ureido group or a cyano group.

The compounds represented by the general formula (A) or (B) have comparatively weak electron-donative properties. To describe more specifically, compounds of general formula (A) or (B) or the electron-donative atomic groups represented by D in the general formula (A) or (B) preferably have an oxidation potential of from about 0 to +1.0 V with respect to a saturated calomel electrode, and more preferably of from about 0.4 to 0.7 V. The oxidation potential is measured using 0.1M sodium perchlorate as the electrolyte and conducting electrolytic oxidation in a solution of acetonitrile/methanol (volume ratio: 15/1) (concentration: about $10^{-3}$ mol/liter) using a rotating platinum disk electrode (750 rpm).

The above-described compounds (A) or (B) are added in amounts of from about $10^{-6}$ to $10^{-2}$ mol, preferably from about $10^{-5}$ to $10^{-3}$ mol, per mol of silver halide in an emulsion layer.

Specific examples of compounds (A) or (B) to be used in the present invention are illustrated below, but the present invention should not be construed as being limited thereto.

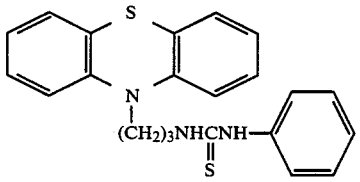

1.

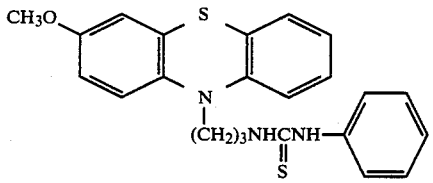

2.

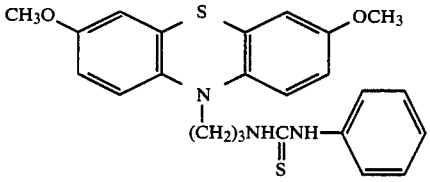

3.

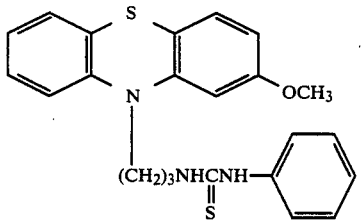

4.

-continued
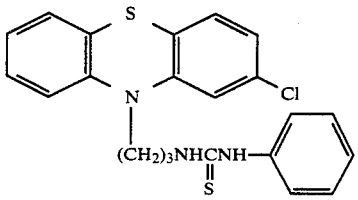
5.
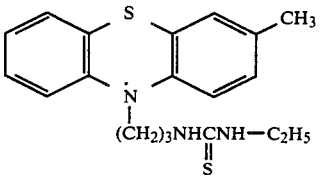
6.
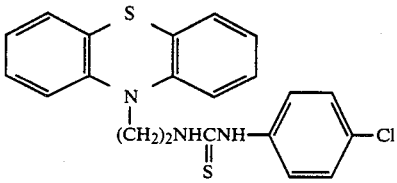
7.
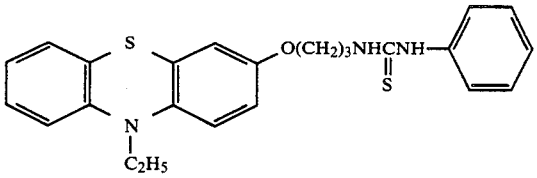
8.
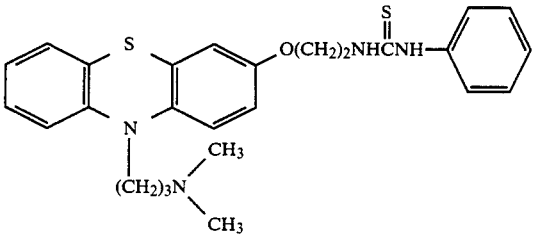
9.
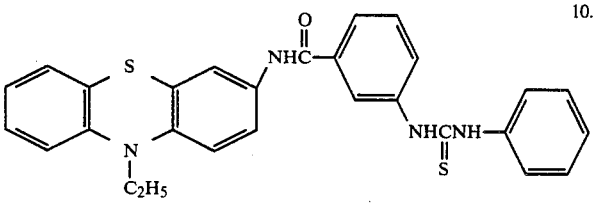
10.
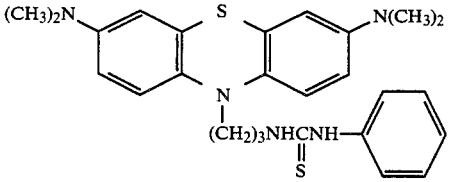
11.
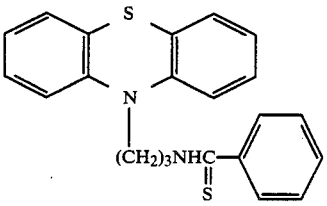
12.
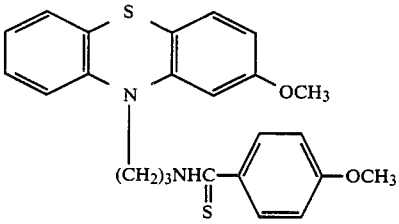
13.
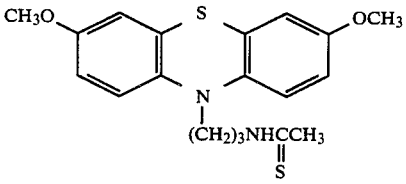
14.
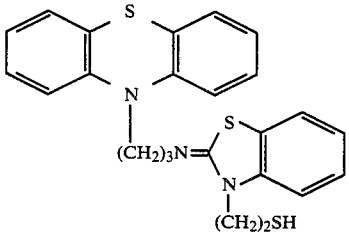
15.
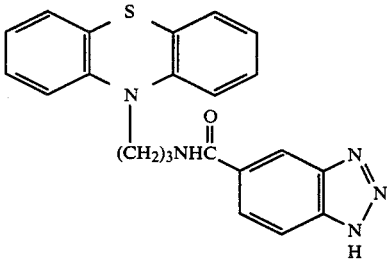
16.
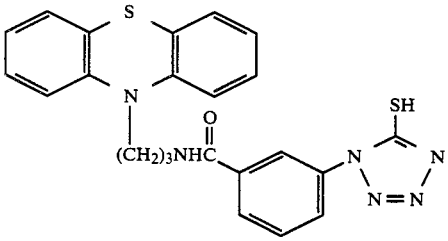
17.
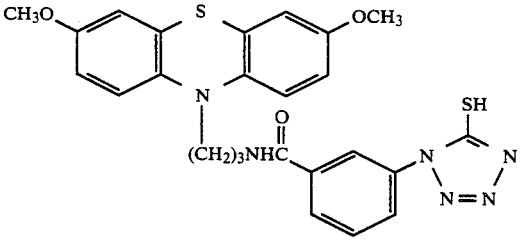
18.

-continued
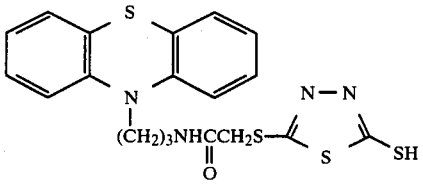
19.
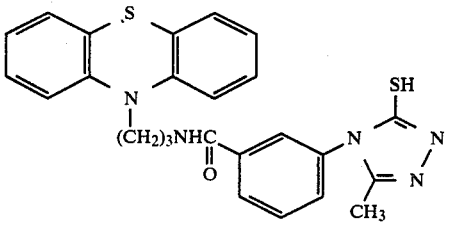
20.
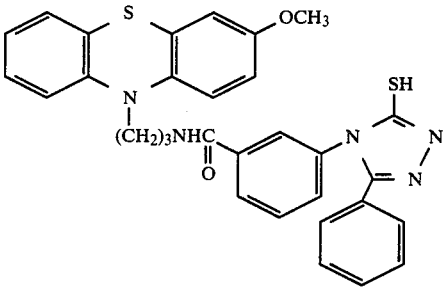
21.
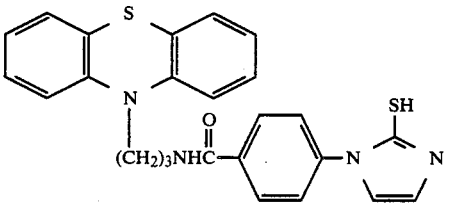
22.
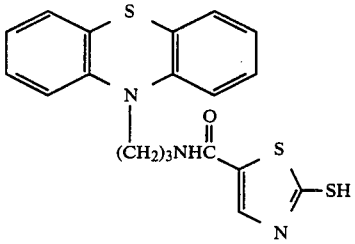
23.
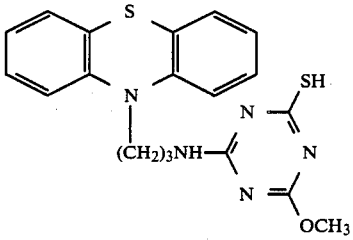
24.
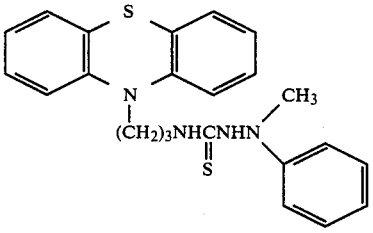
25.
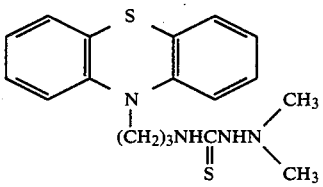
26.
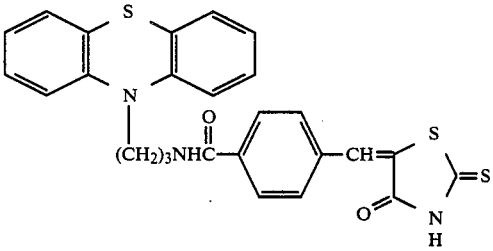
27.
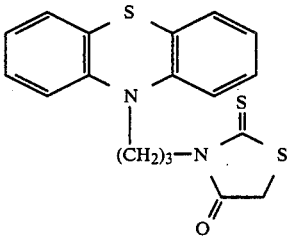
28.
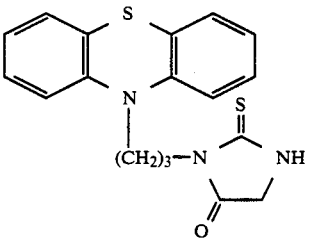
29.
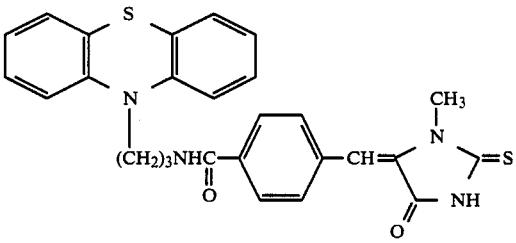
30.

-continued
31.
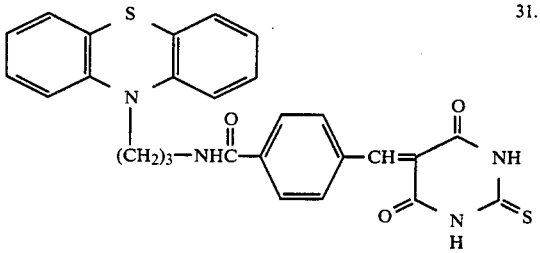
32.
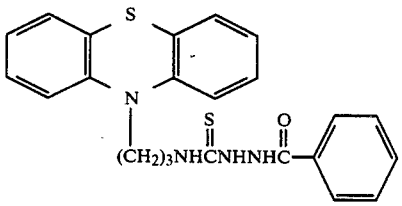
33.
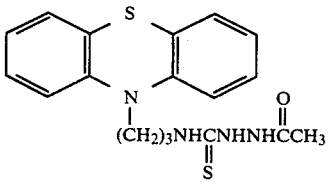
34.
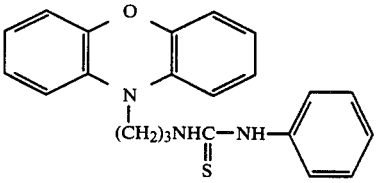
35.
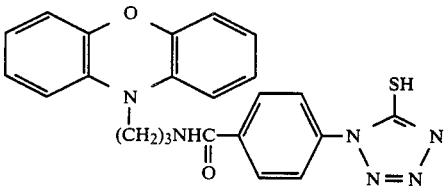
36.
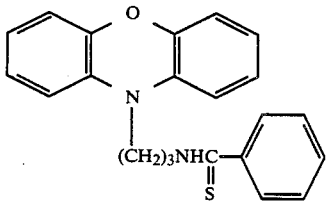
37.
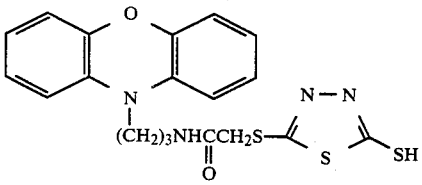
38.
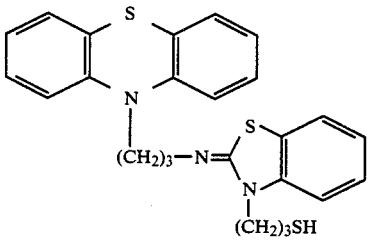
39.
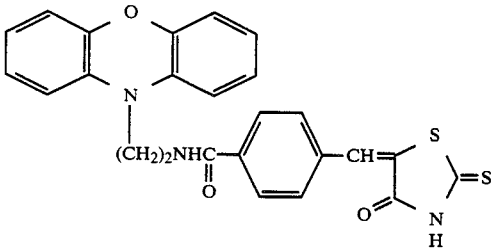
40.
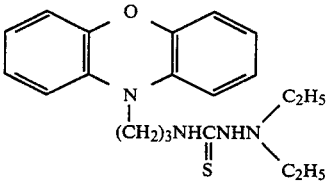
41.
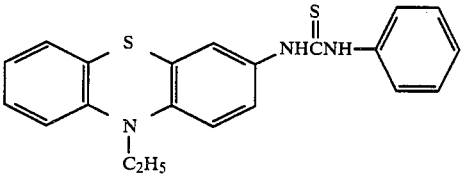
42.
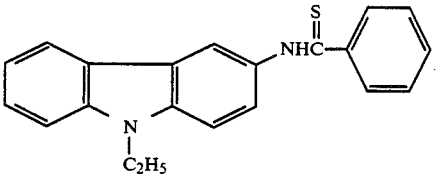
43.
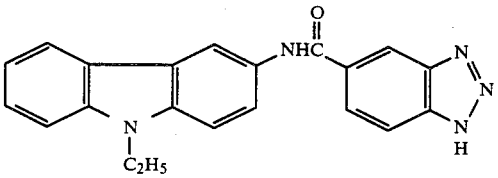
44.
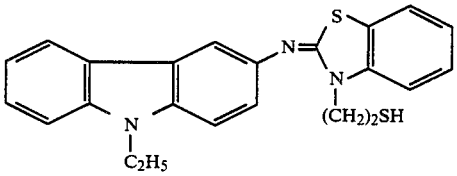

45-continued
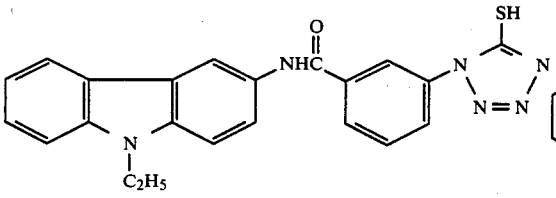
46.
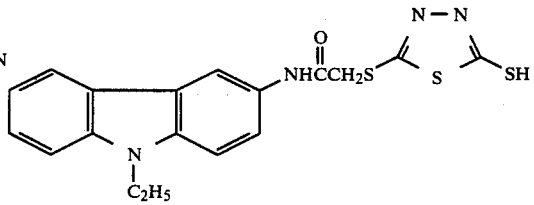
47.
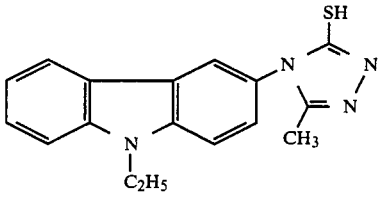
48.
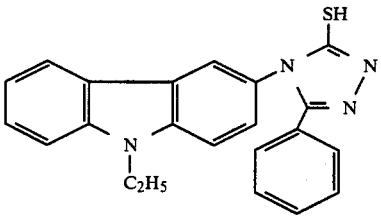
49.
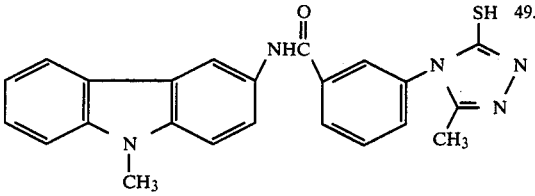
50.
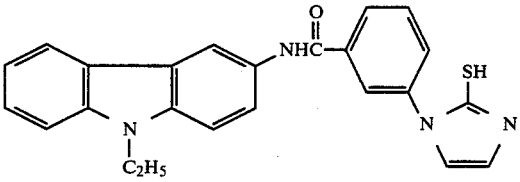
51.
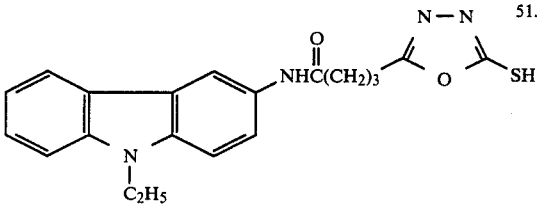
52.
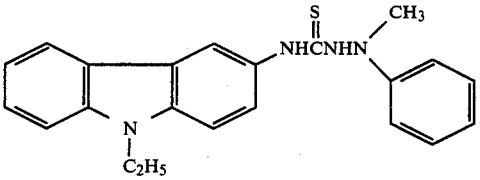
53.
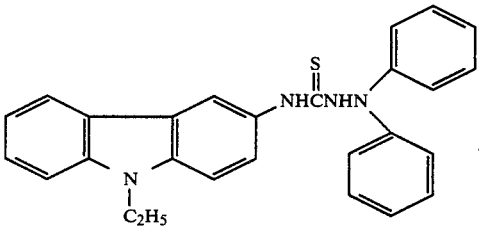
54.
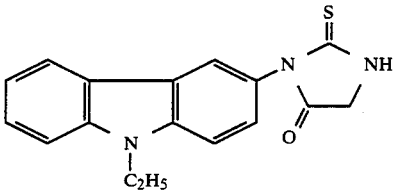
55.
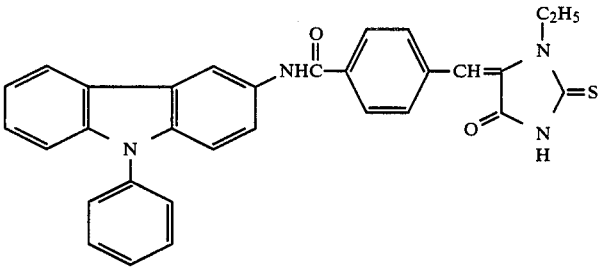
56.
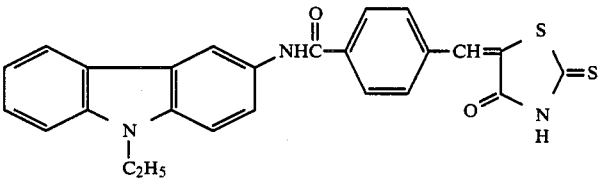

-continued
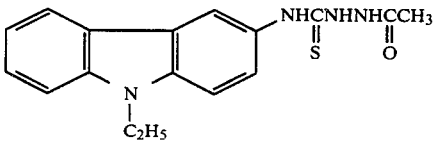
57.
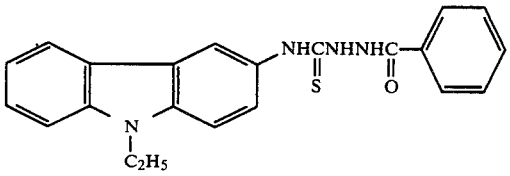
58.
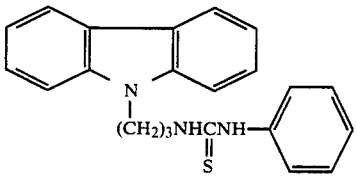
59.
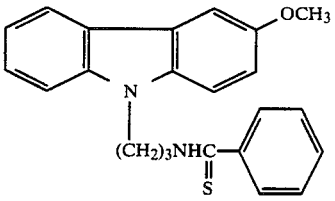
60.
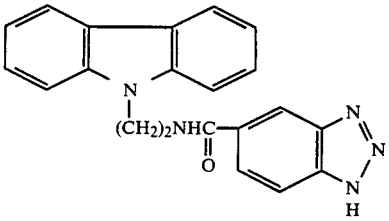
61.
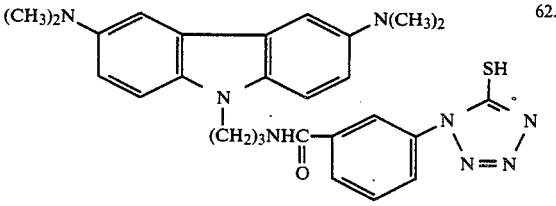
62.
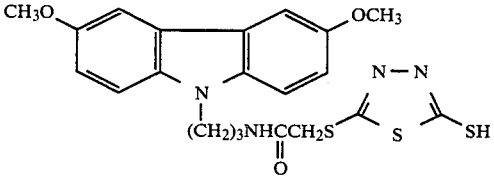
63.
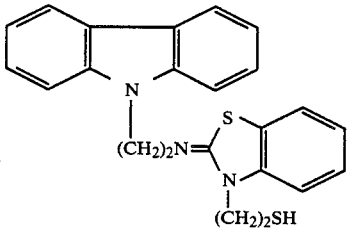
64.
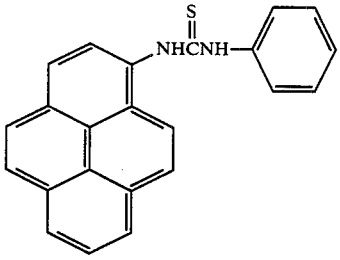
65.
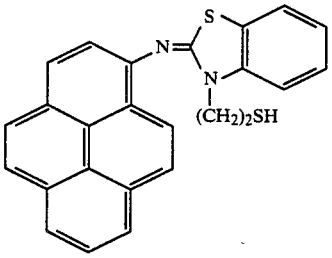
66.
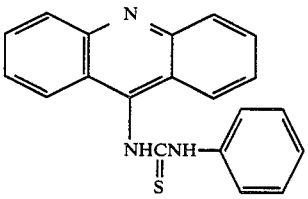
67.
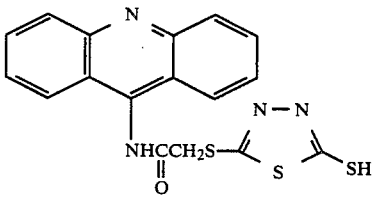
68.
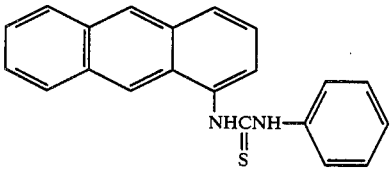
69.
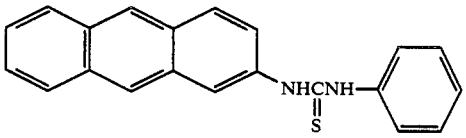
70.

-continued
71.
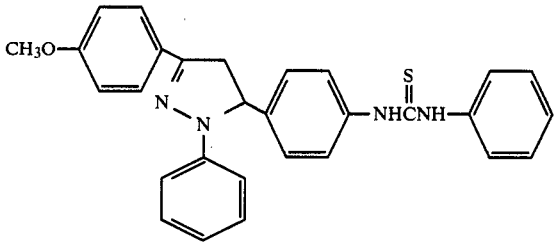
72.
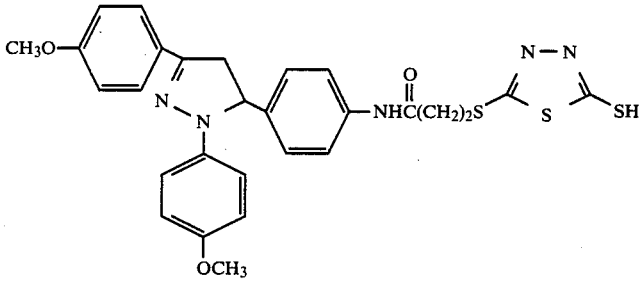
73.
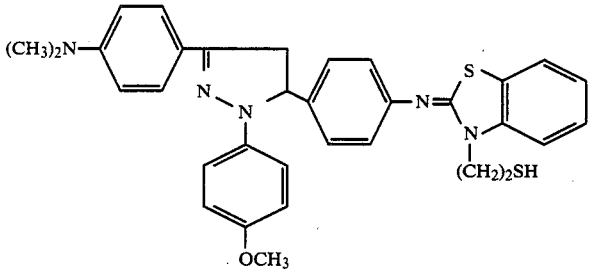
74.
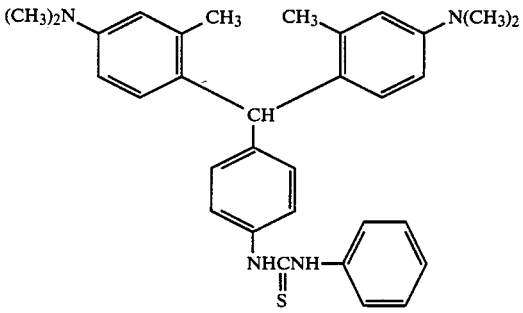
75.
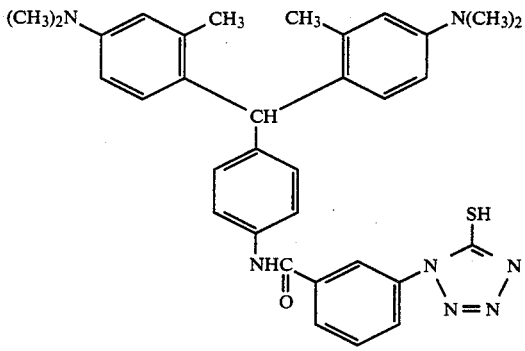
76.
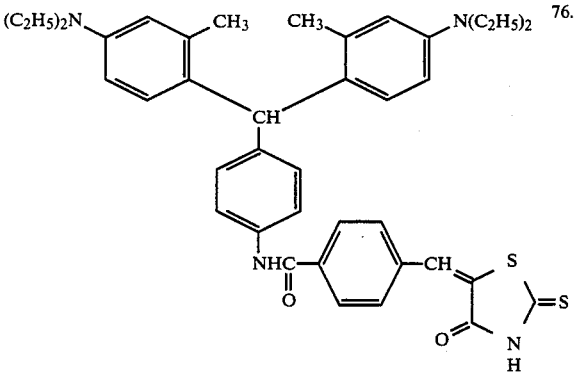
77.
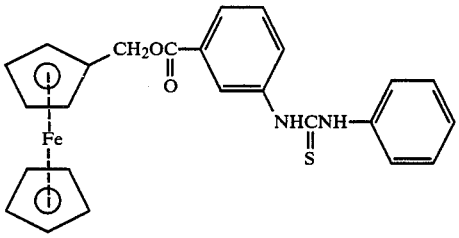

-continued
78.
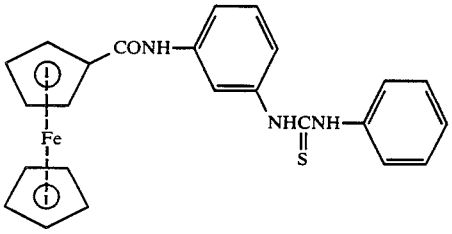
79.
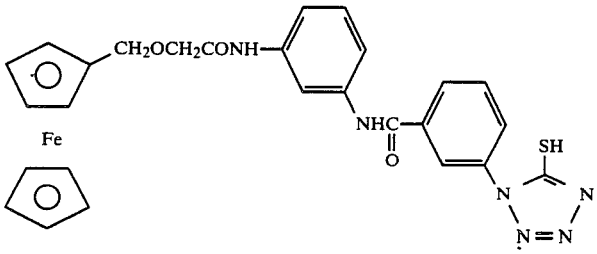
80.
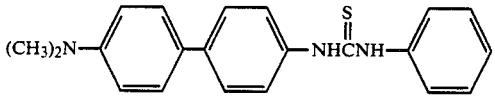
81.
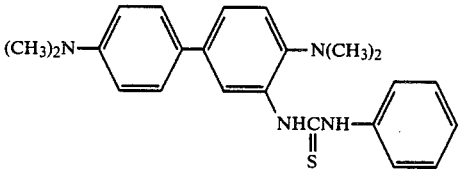
82.
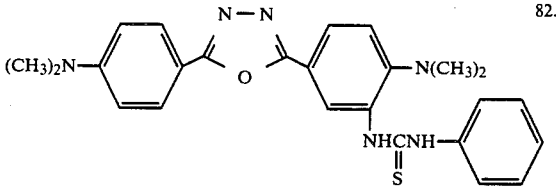
83.
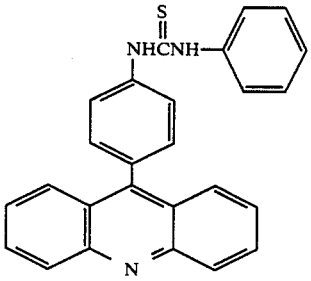
84.
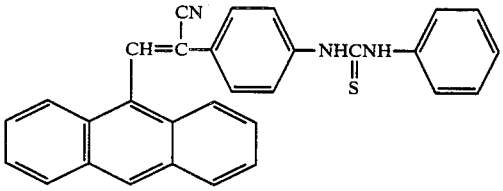
85.
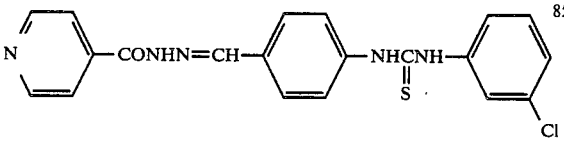
86.
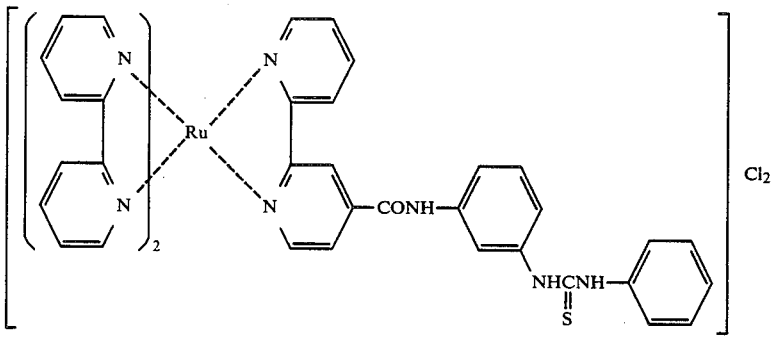
87.
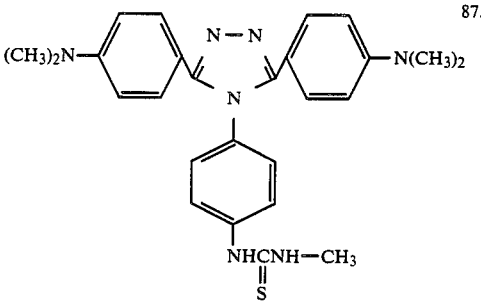
88.
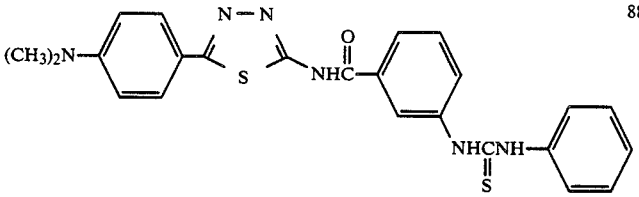

-continued
89.
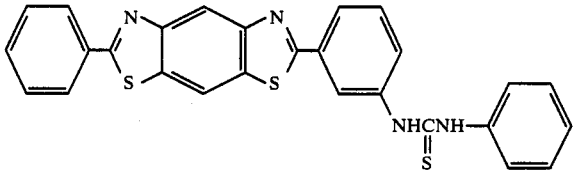
90.
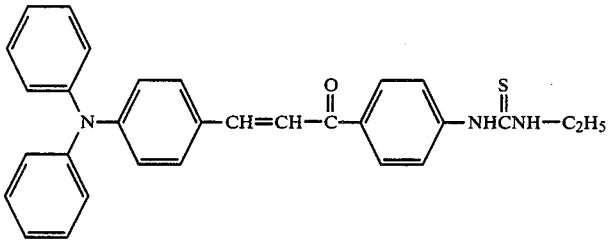
91.
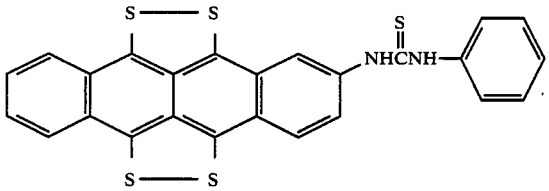
92.
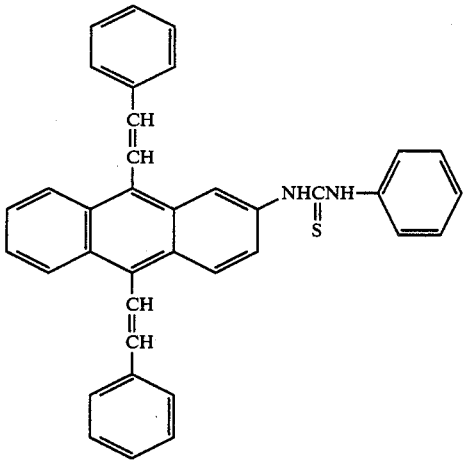
93.
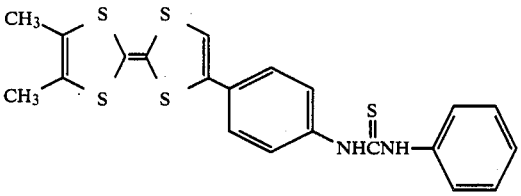
94.
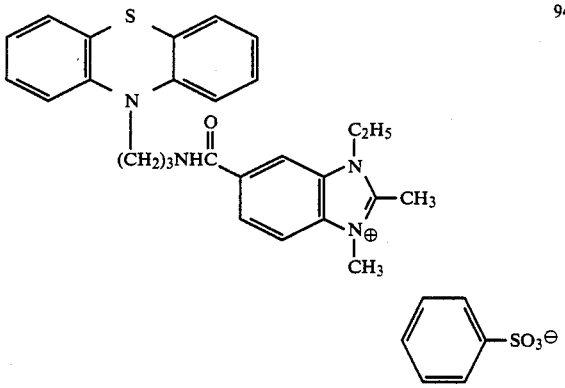

-continued

95.

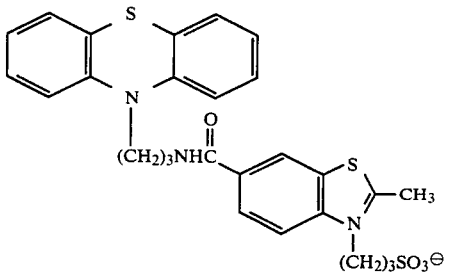

96.

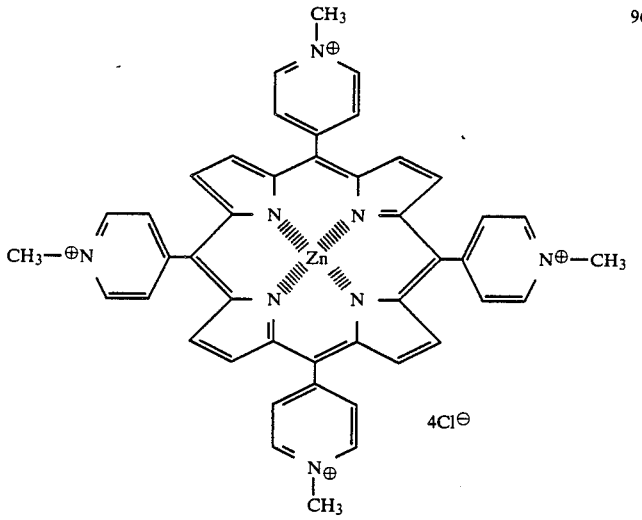

Typical examples of synthesis of compounds represented by formulae (I) and (II) follow. Other compounds can also be synthesized by analogy using appropriately selected known starting materials.

1. Synthesis of Compound 1

1-1. Preparation of 10-(2-Cyanoethyl)phenothiazine 4 ml of Triton B (40%) (benzyltrimethylammonium hydroxide) was dropwise added to an acetonitrile solution (200 ml) containing 199 g of phenothiazine, 106 g of acrylonitrile, and a small quantity of Irganox 1010 (made by Ciba Geigy Co.). Irganox 1010 has the formula

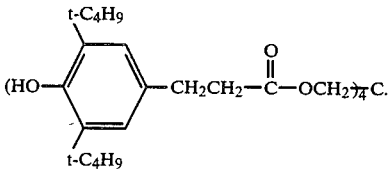

After refluxing for 3 hours while heating, 53 g of acrylonitrile was added thereto, followed by refluxing for a further 2 hours while heating. After being allowed to cool, acetone was added to the reaction solution to crystallize the reaction product. Crystals thus formed were collected by filtration, and recrystallized from 900 ml of acetone to obtain 135 g of the desired compound. m.p. 158°–160° C.

1-2. Preparation of 10-(3-Aminopropyl)phenothiazine 96.5 g of boron trifluoride ethyl etherate was dropwise added to a dispersion of 19.7 g of sodium borohydride in 500 ml of tetrahydrofuran while ice-cooling. After stirring for 30 minutes, 94 g of the compound obtained in 1-1. Was added thereto, and the reaction was conducted for 1 hour while ice-cooling and then for 3 hours at room temperature. Excess diborane was decomposed with 20 ml of water, and 250 ml of concentrated hydrochloric acid was added thereto, followed by conducting the reaction for 4 hours at 50° C. The reaction solution was rendered alkaline with 400 ml of a 33% NaOH (130 g) aqueous solution, and after stirring for 5 hours at 50° C., the solution was extracted with ethyl acetate, and the extract was washed with water. After concentration, distillation of the concentrate under reduced pressure yielded 58 g of the desired compound (b.p. 215°–220° C./1 mmHg).

1-3. Preparation of 10-[3-(3-Phenylthioureido)propyl]-phenothiazine 5.1 g of the compound obtained in 1-2. was reacted with 2.8 g of phenyl isothiocyanate in 50 ml of tetrahydrofuran at room temperature for 3 hours. The reaction solution was concentrated by means of an evaporator, and the concentrate was subjected to silica gel column chromatography (developing solution: $CHCl_3$) for purification and separation, followed by recrystallization from 20 ml of chloroform/hexane (1:1 by volume) to obtain 3 g of the desired end product. m.p. 134°–135° C.

2. Synthesis of Compound 3

2-1. Preparation of 4-Hydroxy-4'-methoxydiphenylamine 110 g of hydroquinone, 148 g of p-anisidine, 5 g of sulfanilic acid, and 20 ml of xylene were stirred during heating using an oil bath of a temperature of 230° C. to react for 2.5 hours while removing distilled water. After being allowed to cool, the reaction product was precipitated with methanol and, after removing solids by filtration, the filtrate was concentrated to obtain 168 g of the desired compound.

2-2. Preparation of 4,4'-Dimethoxydiphenylamine 168 g of the crude crystal compound obtained in 2-1. and 118 g of dimethylsulfuric acid were dissolved in 400 ml of acetone, and 40 wt% NaOH aqueous solution (NaOH 41.5 g) was dropwise added thereto while ice-cooling. After further reaction for 5 hours at room temperature, 400 ml of water was added to the reaction solution. Crystals thus precipitated were collected by filtration. Recrystallization of the product from 1 liter of ethanol gave 77 g of the desired compound.

2-3. Preparation of 3,7-Dimethoxyphenothiazine

A mixture of 77 g of 4,4'-dimethoxydiphenylamine and 22 g of sulfur was heated to 80° C., and, after adding 0.3 g of iodine thereto, the mixture was heated using an oil bath of a temperature of 180° C. for 2 hours to react. After being allowed to cool, 200 ml of acetone was added thereto, and crystals formed were collected by filtration. Recrystallization from chloroform/methanol (8:1 by volume) yielded 41 g of the desired compound. m.p. 198°–200° C.

2-4. Preparation of 10-(2-Cyanoethyl)-3,7-dimethoxyphenothiazine 12.3 g of the compound obtained in 2-3. was reacted with 150 g of acrylonitrile in acetonitrile according to 1-1. using 0.1 ml of Irganox 1010 and 7 ml of Triton B, and the reaction product was separated and purified by silica gel column chromatography (developing solution: $CHCl_3$) and recrystallized from a mixture solvent of 60 ml of $CH_3OH$ and 10 ml of $CHCl_3$ to obtain 11.7 g of the desired compound. m.p. 111°-113° C.

2-5. Preparation of 10-(3-Aminopropyl)-3,7-dimethoxyphenothiazine 6.2 g of the compound obtained in 2-4. was reduced with 6.3 g of $NaBH_4$—$BF_3O(C_2H_5)_2$ (1.1 g/5.2 g) according to the process described in 1-2. to obtain 6.2 g of the desired compound.

2-6. Preparation of 3,7-Dimethoxy-10-[3-(3-phenylthioureido)propyl]phenothiazine 1.6 g of the compound obtained in 2-5. and 0.68 g of phenyl isothiocyanate were reacted with each other in 10 ml of acetonitrile at room temperature for 5 hours, and the reaction product was separated and purified through silica gel column chromatography (developing solution: $CHCl_3$) to obtain 1.8 g of the desired Compound 3 in a glassy state (softening point: about 70° C., liquefaction temperature: about 105° C.).

3. Synthesis of Compound 12

40% NaOH aqueous solution (NaOH 1.3 g) was added to a dispersion of 7.7 g of 10-(3-aminopropyl)-phenothiazine and 7.0 g of S-(thiobenzoyl)thioglycolic acid in 150 ml of tetrahydrofuran during stirring at room temperature, and the reaction was further conducted for 5 hours at room temperature. Water was added to the reaction solution, and the solution ws extracted with ethyl acetate. After evaporation of solvents from the extract, the residue was subjected to silica gel column chromatography for separation and purification (using $CHCl_3$ as a developing solution). Recrystallization of the product from 100 ml of a $CHCl_3$-hexane (4/1 by volume) mixture yielded 8.1 g of the desired compound. m.p. 111°-113° C.

4. Synthesis of Compound 15

6.1 g of 10-(3-aminopropyl)phenothiazine and 6.5 g of thiazolidino[2,3-b]benzothiazolium bromide were dispersed in 50 ml of dimethylformamide (DMF), and, while stirring at room temperature, 3.6 ml of triethylamine was added dropwise thereto. After reacting at 60° C. for 3 hours, 100 ml of water was added to the reaction solution, followed by extraction with 200 ml of ethyl acetate. The extract was washed with water, evaporated to remove solvent, and the residue was subjected to silica gel column chromatography for separation and purification using $CHCl_3$ as a developing solution. Thus, there was obtained 5.7 g of the desired compound in an oily state.

5. Synthesis of Compound 16

5.1 g of 10-(3-aminopropyl)phenothiazine and 3.3 g of benzothiazole-5-carboxylic acid were dissolved in a solvent mixture of 50 ml of dimethylformamide and 50 ml of tetrahydrofuran, and, while stirring at room temperature, 4.3 g of dicyclohexylcarbodiimide and 0.4 g of 4-dimethylaminopyridine were added thereto. After reacting for 2 hours at room temperature and for 4 hours at 60° C., solids were removed by filtration, and 100 ml of water was added to the filtrate, followed by extraction with 300 ml of ethyl acetate and washing with 200 ml of water. The crude product was separated and purified by silica gel column chromatography (using as a developing solution $CHCl_3$, then a mixture of $CHCl_3$ and $CH_3OH$ (20/1 by volume)), followed by recrystallization from methanol/acetonitrile (50 ml/100 ml) to obtain 5.5 g of the desired end compound. m.p. 150°-154° C. (decomposition point).

6. Synthesis of Compound 18

1.6 g of 10-(3-aminopropyl)-3,7-dimethoxyphenothiazine and 1.1 g of 1-(3-carboxyphenyl)-5-mercaptotetrazole were dissolved in a solvent mixture of 5 ml of dimethylformamide and 10 ml of tetrahydrofuran. 1.0 g of dicyclohexylcarbodiimide and 0.1 g of 4-dimethylaminopyridine were added thereto, and reaction was conducted at room temperature for 4 hours. After-treatment was conducted in the same manner as in Synthesis Example 5. After separation and purification by silica gel column chromatography using $CHCl_3$, then a mixture of $CHCl_3$ and $CH_3OH$ (50/1-10/1 by volume) as a developing solution, the product was recrystallized from 20 ml of $CHCl_3$/hexane (1/1 volume) to obtain 1.4 g of the desired compound. m.p. 174°-175° C. (decomposition).

7. Synthesis of Compound 19

In a manner analogous to the process described in Synthesis Example 6, except using 3.8 g of 10-(3-aminopropyl)phenothiazine and 3.1 g of 2-carboxymethylthio-5-mercapto-1,3,4-thiadiazole, there was obtained 4.2 g of the desired end compound 4.2 g. m.p. 164°-166° C.

8. Synthesis of Compound 28

5.1 g of 10-(3-aminopropyl)phenothiazine and 3.1 ml of triethylamine were dissolved in a solvent mixture of 20 ml of methanol and 15 ml of tetrahydrofuran, and, under cooling with ice, 1.7 g of carbon disulfide was added dropwise thereto. After stirring the mixture at room temperature for 3 hours, 3.7 g of ethyl bromoacetate was added dropwise thereto, followed by reacting for further 3 hours at room temperature. 50 ml of water was added to the reaction product, and, after removing the aqueous layer by decantation, the resulting oily product was separated and purified by silica gel column chromatography using $CHCl_3$/hexane (1/1 by volume) as a developing solution to obtain 6.4 g of the desired oily compound.

9. Synthesis of Compound 33

9-1. Preparation of 10-(3-Isothiocyanatopropyl)phenothiazine 4.2 g of carbon disulfide was added dropwise to a solution of 12.8 g of 10-(3-aminopropyl)phenothiazine and 7.7 ml of triethylamine in 100 ml of tetrahydrofuran. After stirring the solution at room temperature for 2 hours, a solution of 11.3 g of dicyclohexylcarbodiimide in 20 ml of tetrahydrofuran was added dropwise thereto, and the reaction was conducted at room temperature for 5 hours. After removing solvents in vacuo, 50 ml of ethyl acetate was added to the residue, and the crystals precipitated were collected by filtration, and the filtrate was concentrated to obtain 18.6 g of the desired compound (oily).

9-2. Preparation of 1-Acetyl-4-(3-phenothiazinopropyl)-thiosemicarbazide 7.3 g of 10-(3-isothiocyanatopropyl)phenothiazine was reacted with 1.5 g of acetylhydrazine in 30 ml of tetrahydrofuran for 3 hours by refluxing under heating, and the product was separated and purified through silica gel column chromatography (using a mixture of $CHCl_3$ and $CH_3OH$ (50/1 by volume) as a developing solution, and recrystallization from 20 ml of $CH_2Cl_2$ to obtain 2.5 g of the desired compound. m.p. 188°-190° C.

10. Synthesis of Compound 34

2.2 g of 10-(3-aminopropyl)phenoxazine, prepared from phenoxazine and acrylonitrile in an analogous manner to Synthesis Example 1, was reacted with 1.5 g of phenyl isothiocyanate in 25 ml of acetonitrile at room temperature. The product was purified through silica gel column chromatography using a mixture of $CHCl_3$ and hexane (4/1 by volume) as a developing solution and recrystallization from 30 ml of $CHCl_3$/hexane (1/1 by volume) to obtain 2.5 g of the desired compound. m.p. 118°-120° C.

11. Synthesis of Compound 41

16.8 g of 3-amino-9-ethylcarbazole was reacted with 11.9 g of phenyl isothiocyanate in 90 ml of tetrahydrofuran at room temperature for 3 hours, and 300 ml of methanol was added thereto. Crystals thus precipitated were collected by filtration, dissolved in 50 ml of dimethylformamide, and filtered. Then, 250 ml of methanol was added to the filtrate to recrystallize. Thus, there was obtained 15.0 g of the desired end product. m.p. 179°-180° C.

12. Synthesis of Compound 43

16.8 g of 3-amino-9-ethylcarbazole and 13.0 g of benzotriazole-5-carboxylic acid were treated with 18.2 g of dicyclohexylcarbodiimide and 2 g of 4-dimethylaminopyridine in a mixed solution of 30 ml of dimethylformamide and 120 ml of tetrahydrofuran in an analogous manner to Synthesis Example 5, followed by recrystallization from $CH_3OH$/acetone to obtain 8.5 g of the desired end compound. m.p. 186°-190° C.

13. Synthesis of Compound 44

4.2 ml of triethylamine was added to a solution of 6.3 g of 3-amino-9-ethylcarbazole and 8.2 g of thiazolino[2,3-b]benzothiazolium bromide in 100 ml of dimethylformamide and, after reacting for 3 hours at 50° C., 200 ml of methanol and 50 ml of water were added thereto. Crystals thus precipitated were collected by filtration, then recrystallized from dimethylformamide/acetonitrile (400 ml/400 ml) to obtain 7.5 g of the desired end compound. m.p. 208°-210° C.

14. Synthesis of Compound 45

1-(3-Carboxyphenyl)-5-mercaptotetrazole and 4.2 ml of triethylamine were dissolved in 30 ml of tetrahydrofuran and, while stirring under ice-cooling, 3.3 g of ethyl chloroformate was added dropwise thereto. After reacting for 2 hours at room temperature, 3.2 g of 3-amino-9-ethylcarbazole was added thereto, followed by reacting for further 3 hours at room temperature. Then, 12.7 ml of a 15% KOH aqueous solution (KOH 1.9 g) was added to the reaction solution and, after stirring at 50° C. for 2 hours, it was neutralized with 2.9 ml of hydrochloric acid, and extracted with 100 ml of ethyl acetate. The extract was washed with water, concentrated, and recrystallized from 20 ml of $CHCl_3/CH_3OH$ (3/1 by volume) to obtain 1.6 g of the desired end compound. m.p. 199°-200° C. (decomposition).

15. Synthesis of Compound 57

15-1. Preparation of 9-Ethyl-3-isocyanatocarbazole 38.6 g of 3-amino-9-ethylcarbazole and 27.9 ml of triethylamine were added to 300 ml of methanol, and, while cooling with ice, 15.2 g of carbon disulfide was added dropwise thereto. After conducting reaction at room temperature for 3 hours, 41.3 g of dicyclohexylcarbodiimide was added thereto, followed by reacting at room temperature for 4 hours. Crystals thus precipitated were collected by filtration, heat-refluxed for 10 minutes in 500 ml of ethyl acetate, and cooled to precipitate and then filter off solids. The filtrate was concentrated by removing solvents in vacuo to obtain the desired product (29 g).

15-2. Preparation of 1-Acetyl-4-(9-ethyl-3-carbazolyl)-thiosemicarbazide 3.8 g of 9-ethyl-3-isothiocyanatocarbazole was reacted with 1.1 g of acetylhydrazine in 30 ml of tetrahydrofuran at 60° C. for 2 hours. Then, 10 ml of methanol was added thereto and crystallization was conducted while cooling with ice. Crystals thus precipitated were collected by filtration, and recrystallized from $CHCl_3/CH_3OH$ (70 ml/200 ml) to obtain 2.4 g of the desired end compound. m.p. 197°-199° C.

16. Synthesis of Compound 47

1.7 g of Compound 57 was reacted with 2.4 g of a 28% $CH_3ON$ a methanol solution in 30 ml of methanol by refluxing while heating for 2 hours. Then, 0.9 ml of acetic acid was added to the reaction solution, and crystallization was conducted while cooling with ice. Crystals thus precipitated were collected by filtration and recrystallized from 20 ml of $CHCl_3/CH_3OH$ (10/1 by volume) to obtain 1.4 g of the desired end compound. m.p. 267°-269° C.

17. Synthesis of Compound 54

2.1 ml of triethylamine was added dropwise to a dispersion of 3.8 g of 9-ethyl-3-isothiocyanatocarbazole and 2.1 g of glycine ethyl ester hydrochloride in 20 ml of ethanol. After reacting at room temperature for 2 hours, 15 ml of 1N NaOH was added thereto, followed by heat refluxing for 5 hours. After being allowed to cool, 0.9 ml of acetic acid was added thereto, then water was added thereto. Crystals thus precipitated were collected by filtration and recrystallized from 30 ml of $CHCl_3/CH_3OH$ (3/1 by volume) to obtain 1.0 g of the desired end compound. m.p. 255°-257° C. (decomposition).

18. Synthesis of Compound 59

4.5 g of 9-(3-aminopropyl)carbazole, synthesized from carbazole and acrylonitrile in an analgous manner to Synthesis Example 1, was reacted with 2.8 g of phenyl isothiocyanate in 50 ml of tetrahydrofuran at 50° C. for 5 hours. Then, 200 ml of methanol was added thereto, and the crystals thus precipitated were collected by filtration. Recrystallization of the crystals from $CHCl_3$/ethanol (20 ml/60 ml) gave 2.4 g of the desired end compound. m.p. 135°-136° C.

19. Synthesis of Compound 65

1.5 g of 1-aminopyrene and 1.0 g of phenyl isothiocyanate were reacted with each other in 15 ml of acetonitrile was 20 hours, and the crystals precipitated were collected by filtration and recrystallized from dimethylformamide-acetonitrile (15 ml/40 ml) to obtain 1.6 g of the desired end product. m.p. 194°-195° C.

20. Synthesis of Compound 66

1.5 g of 1-aminopyrene was reacted with 1.9 g of thiazolino[2,3-b]benzothiazolium bromide in an analogous manner to Synthesis Example 4, and the reaction product was purified through silica gel column chromatography using $CHCl_3$ as a developing solution to obtain 0.4 g of the desired end compound. m.p. 130°-145° C.

21. Synthesis of Compound 67

15.5 g of 9-aminoacridine was reacted with 11.9 g of phenyl isothiocyanate, and the reaction product was re-precipitated to obtain 4.1 g of the desired compound. m.p. 190°-191° C.

22. Synthesis of Compound 71

22-1. Preparation of 4'-Methoxy-4-nitrochalcone 30 g of p-nitrobenzaldehyde was reacted with 30 g of p-methoxyacetophenone in 200 ml of acetic acid in the presence of 34 ml of sulfuric acid at room temperature for 1 day, and the reaction mixture was poured into 1 liter of ice-water. After neutralizing the mixture with 48 g of NaOH, crystals formed were collected by filtration, and recrystallized from acetone-acetonitrile (0.2 liter/1.3 liter) to obtain 37.6 g of the desired compound. m.p. 171°–173° C.

22-2. Preparation of 3-(4-Methoxyphenyl)-5-(4-nitrophenyl)-1-phenyl-2-pyrazoline 14.2 g of 4'-methoxy-4-nitrochalcone was reacted with 5.4 g of phenylhydrazine in 100 ml of ethanol in the presence of 5 ml of hydrochloric acid by refluxing while heating for 6 hours. After neutralizing the reaction mixture with 50 ml of 1N NaOH, 400 ml of water was added thereto. Decantation-water washing was repeated three times. Crystals formed were recrystallized from 200 ml of acetone to obtain 14.7 g of the desired compound. m.p. 168°–173° C.

22-3. Preparation of 5-(4-Aminophenyl)-3-(4-methoxyphenyl)-1-phenyl-2-pyrazoline 15.8 g of metallic iron powder and 1.6 g of ammonium chloride were dispersed in a mixed solution of 140 ml of iospropyl alcohol and 14 ml of water, and, while stirring and refluxing under heating, 13.1 g of 3-(4-methoxyphenyl)-5-(4-nitrophenyl)-1-phenyl-2-pyrazoline was added thereto. After refluxing for 2 hours, 10 ml of acetic acid was added thereto, and the reaction was thereafter continued for 30 minutes under refluxing. Solids were removed by filtration using sellaite, and 150 ml of water was added to the filtrate. Crystals precipitated were collected by filtration to obtain 9.7 g of 5-(4-aminophenyl)-3-(4-methoxyphenyl)-1-phenyl-2-pyrazoline. m.p. 164°–166° C.

22-4. Preparation of 3-(4-Methoxyphenyl)-5-[4-(3-phenylthioureido)phenyl]-1-phenyl-2-pyrazoline 3.4 g of 5-(4-aminophenyl)-3-(4-methoxyphenyl)-1-phenyl-2-pyrazoline and 1.5 g of phenyl isothiocyanate were reacted in acetonitrile for 5 hours at room temperature, and the product was reprecipitated from 30 ml of dimethylformamide-methanol to obtain 2.7 g of the desired end compound. m.p. 153°–156° C.

23. Synthesis of Compound 74

23-1. Preparation of 4,4'-Dimethylamino-2,2'-dimethyl-4''-nitrotriphenylmethane

A mixture of 66.4 g of N,N-dimethyl-m-toluidine, 30.2 g of p-nitrobenzaldehyde, 18.4 ml of hydrochloric acid, and 5 ml of ethanol was refluxed under heating to react for 3 hours. After cooling the reaction solution, the product was recrystallized from 3 liters of acetone to obtain 62 g of the desired compound. m.p. 231°–233° C.

23-2. Preparation of 4''-Amino-4,4'-dimethylamino-2,2'-dimethyltriphenylmethane 20.2 g of 4,4'-dimethylamino-2,2'-dimethyl-4''-nitrotriphenylmethane was reduced with 22.5 g of metallic iron powder and 2.3 g of ammonium chloride under conditions described in 22-3, and the product was extracted with 300 ml of ethyl acetate to obtain 21.2 g of the desired compound. m.p. 148°–150° C.

23-3. Preparation of 4,4'-Dimethylamino-2,2'-dimethyl-4''-(3-phenylthioureido)triphenylmethane 7.1 g of 4''-amino-4,4'-dimethylamino-2,2'-dimethyltriphenylmethane was reacted with phenyl isothiocyanate in an equimolar amount for 10 hours at room temperature, and the reaction product was purified through silica gel column chromatography (using a mixture of $CHCl_3$ and ethyl acetate (10/1 by volume) as a developing solution) to obtain 5.0 g of the desired end compound. m.p. 114°–116° C.

Conventional spectral sensitizing dyes are used in combination with the supersensitizing agent (A) or (B) of the present invention, including, for example, cyanine dyes, merocyanine dyes, complex cyanine dyes, complex merocyanine dyes, holopolar cyanine dyes, styryl dyes, hemicyanine dyes, oxonol dyes and hemioxonol dyes.

Of these, monomethinecyanines, trimethinecyanines and pentamethinecyanines of cyanine dyes are preferred. These dyes may be used in combination for supersensitization or to adjust color sensitivity or for other purposes. Particularly preferred cyanine dyes are those represented by the following general formula (I) to (VIII):

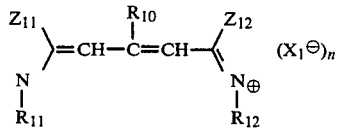

(I)

wherein $Z_{11}$ and $Z_{12}$, which may be the same or different, each represents a non-metallic atomic group necessary to complete a benzothiazole nucleus, a naphthothiazole nucleus, a benzoselenazole nucleus, a naphthoselenazole nucleus, a thiazole nucleus or a thiazoline nucleus; $R_{11}$ and $R_{12}$ each represents an alkyl group; $R_{10}$ represents a hydrogen atom, an alkyl group or an aryl group; $X_1\ominus$ represents an acid anion; and n represents 0 or 1; [in the present invention, the terms "alkyl group (including alkyl residue)" and "aryl group) (including aryl residue)" include substituted alkyl and aryl groups];

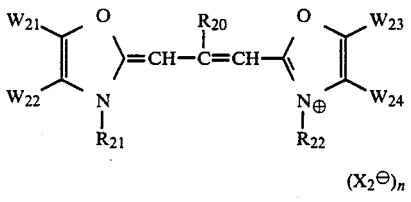

(II)

wherein $W_{21}$, $W_{22}$, $W_{23}$ and $W_{24}$, which may be the same or different, each represents a hydrogen atom, an alkyl group or an aryl group, provided that $W_{21}$ and $W_{22}$, and/or $W_{23}$ and $W_{24}$ may combine to form an optionally substituted benzene ring or an optionally substituted naphthalene ring; $R_{21}$ and $R_{22}$, which may be the same or different, each represents an alkyl group; $R_{20}$ represents a hydrogen atom, an alkyl group or an aryl group; $X_2\ominus$ represents an acid anion; and n represents 0 or 1;

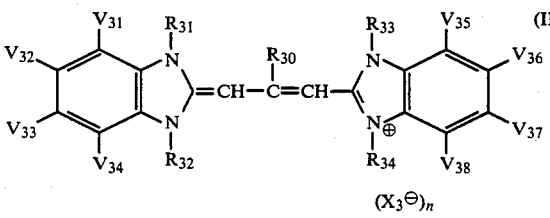

(III)

wherein $V_{31}$ to $V_{38}$, which may be the same or different, each represents a hydrogen atom, a halogen atom, a trifluoromethyl group, a cyano group, a carboxyl group, an alkoxycarbonyl group, a sulfamoyl group, a sulfonyl group, or a carbamoyl group, and any of $V_{31}$ and $V_{32}$, $V_{32}$ and $V_{33}$, $V_{33}$ and $V_{34}$, $V_{35}$ and $V_{36}$, $V_{36}$ and $V_{37}$, or $V_{37}$ and $V_{38}$ may combine to form a carbon ring including a substituted or unsubstituted benzene ring; $R_{31}$ to $R_{34}$, which may be the same or different, each represents an alkyl group or a substituted alkyl group; $R_{30}$ represents a hydrogen atom, an alkyl group or an aryl group; $X_3\ominus$ represents an acid anion; and n represents 0 or 1;

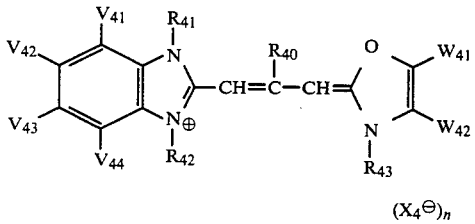

(IV)

wherein $V_{41}$ to $V_{44}$, $R_{41}$ and $R_{42}$ are respectively the same as $V_{31}$ to $V_{34}$, $R_{31}$ and $R_{32}$ in general formula (III); $W_{41}$, $W_{42}$ and $R_{43}$ are respectively the same as $W_{21}$, $W_{22}$ and $R_{21}$ in general formula (II); $R_{40}$ represents a hydrogen atom, an alkyl group or an aryl group; $X_4\ominus$ represents an acid anion; and n represents 0 or 1;

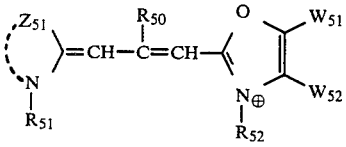

(V)

wherein $Z_{51}$, $R_{50}$ and $R_{51}$ are respectively the same as $Z_{11}$, $R_{10}$ and $R_{11}$ in general formula (I); $W_{51}$, $W_{52}$ and $R_{52}$ are respectively the same as $W_{21}$, $W_{22}$ and $R_{21}$ in general formula (II); $X_5\ominus$ represents an acid anion; and n represents 0 or 1;

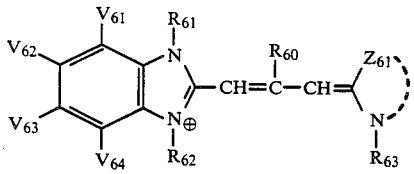

(VI)

wherein $V_{61}$ to $V_{64}$, $R_{61}$ and $R_{62}$ are respectively the same as $V_{31}$ to $V_{34}$, $R_{31}$ and $R_{32}$ in general formula (III); $Z_{61}$, $R_{63}$ and $R_{60}$ are respectively the same as $Z_{11}$, $R_{12}$ and $R_{10}$ in general formula (I), or $Z_{61}$ further represents a non-metallic atomic group necessary for completing an indoline nucleus; $X_6\ominus$ represents an acid anion; and n represents 0 or 1;

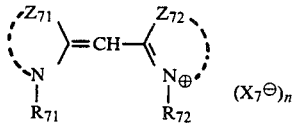

(VII)

wherein $Z_{71}$ and $Z_{72}$, which may be the same or different, each represents a non-metallic atomic group necessary for completing a benzoxazole nucleus, a benzothiazole nucleus, a benzoselenazole nucleus, a naphthoxazole nucleus, a naphthothiazole nucleus, a naphthoselenazole nucleus, a thiazole nucleus, a thiazoline nucleus, an oxazole nucleus, a selenazole nucleus, a selenazoline nucleus, a pyridine nucleus or a quinoline nucleus; $R_{71}$ and $R_{72}$, which may be the same or different, each represents an alkyl group; $X_7\ominus$ represents an acid anion; and n represents 0 or 1; and

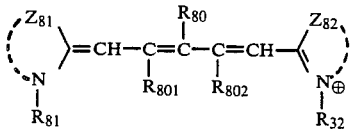

(VIII)

wherein $Z_{81}$ and $Z_{82}$, which may be the same or different, each represents a non-metallic atomic group necessary for completing a pyridine nucleus, a quinoline nucleus, a benzothiazole nucleus, a naphthothiazole nucleus, a benzoxazole nucleus, a benzoselenazole nucleus, a naphthoxazole nucleus, a naphthoselenazole nucleus, a thiazole nucleus or a thiazoline nucleus; $R_{81}$ and $R_{82}$, which may be the same or different, each represents an alkyl group; $R_{80}$, $R_{801}$ and $R_{802}$, which may be the same or different, each represents a hydrogen atom, an alkyl group or a halogen atom, provided that $R_{801}$ and $R_{802}$ may combine to form a ring; $X_8\ominus$ represents an acid anion; and n represents 0 or 1.

The alkyl groups represented by $R_{11}$, $R_{12}$, $R_{21}$, $R_{22}$, $R_{31}$, $R_{32}$, $R_{33}$, $R_{34}$, $R_{41}$, $R_{42}$, $R_{43}$, $R_{51}$, $R_{52}$, $R_{61}$, $R_{62}$, $R_{63}$, $R_{71}$, $R_{72}$, $R_{81}$ and $R_{82}$ include substituted and unsubstituted alkyl groups. Preferably the unsubstituted alkyl groups contain 18 or fewer carbon atoms, and particularly preferably 8 or fewer carbon atoms, for example, including a methyl group, an ethyl group, an n-propyl group, an n-butyl group, an n-hexyl group, and an n-octadecyl group. Preferably the substituted alkyl groups contain 6 or fewer carbon atoms, and particularly preferably 4 or fewer carbon atoms in the alkyl moiety, for example, including a sulfo group-substituted alkyl group (the sulfo moiety optionally being connected to the alkyl moiety through, for example, an alkoxy group or an aryl group, e.g., a 2-sulfoethyl group, a 3-sulfopropyl group, a 3-sulfobutyl group, a 4-sulfobutyl group, a 2-(3-sulfopropoxy)ethyl group, a 2-[2-(3-sulfopropoxy)ethoxy]ethyl group, a 2-hydroxy-3-sulfopropyl group, a p-sulfophenethyl group or a p-sulfophenylpropyl group); a carboxy-substituted alkyl group (the carboxy moiety optionally being connected to the alkyl moiety through, for example, an alkoxy group or an aryl group, e.g., a carboxymethyl group, a 2-carboxyethyl group, a 3-carboxypropyl group or a 4-carboxybutyl group); a hydroxyalkyl group (e.g., a 2-hydroxyethyl group or a 3-hydroxypropyl group); an acyloxyalkyl group (e.g., a 2-acetoxyethyl group or a 3-acetoxypropyl group); an alkoxyalkyl group (e.g., a 2-methoxyethyl group or a 3-methoxypropyl group); an alkoxycarbonylalkyl group (e.g., a 2-methoxycarbonylethyl group, a 3-methoxycarbonylpropyl group or a 4-ethoxycarbonylbutyl group); a vinyl-substituted alkyl group (e.g., an allyl group); a cyanoalkyl group (e.g., a 2-cyanoethyl group); a carbamoylalkyl group (e.g., a 2-carbamoylethyl group); an aryloxyalkyl group (e.g., a 2-phenoxyethyl group or a 3-phenoxypropyl group); an aralkyl group (e.g., a 2-phenethyl group or a 3-phenylpropyl group); an aryloxyalkyl group (e.g., a 2-phenoxyethyl group or a 3-phenoxypropyl group).

The alkyl groups represented by $R_{10}$, $R_{20}$, $R_{30}$, $R_{40}$, $R_{50}$, $R_{60}$, $R_{80}$, $R_{801}$ and $R_{802}$ include substituted and unsubstituted alkyl groups. As unsubstituted alkyl groups, those which contain up to 4 carbon atoms are preferable, for example, a methyl group, an ethyl group or a propyl group. Substituted alkyl groups include aralkyl groups (e.g., a benzyl group or a 2-phenethyl group), and aryl groups include, for example, a phenyl group.

The halogen atom represented by $R_{80}$, $R_{801}$ and $R_{802}$ can include, e.g., a chlorine atom, a fluorine atom or a bromine atom. The ring formed by $R_{801}$ and $R_{802}$, when these groups combine, may be a 6-membered ring. $R_{10}$, $R_{20}$ and $R_{50}$ preferably represent an ethyl group, and $R_{30}$, $R_{40}$ and $R_{60}$ preferably represent a hydrogen atom.

The acid anion group represented by $X_1^{\ominus}$ to $X_8^{\ominus}$ includes, for example, chloride, bromide, iodide, methylsulfate, ethylsulfate and p-toluenesulfonate ion.

n represents 0 or 1 and, where the dye forms an inner salt, n represents 0.

$V_{31}$ to $V_{38}$, $V_{41}$ to $V_{44}$, and $V_{61}$ to $V_{64}$ each represents a hydrogen atom, a halogen atom (e.g., a fluorine atom, a chlorine atom, a bromine atom or an iodine atom), a trifluoromethyl group, a cyano group, a carboxyl group, an alkoxycarbonyl group (e.g., a methoxycarbonyl group, or an ethoxycarbonyl group), a sulfamoyl group (e.g., a sulfamoyl group, or an alkylsulfamoyl group such as a methylsulfamoyl group, a dimethylsulfamoyl group or a diethylsulfamoyl group), a sulfonyl group (e.g., an alkylsulfonyl group such as a methylsulfonyl group or an arylsulfonyl group such as a phenylsulfonyl group), or a carbamoyl group (e.g., an N-alkylcarbamoyl group such as an N-methylcarbamoyl group or an N-arylcarbamoyl group such as an N-phenylcarbamoyl group).

$V_{31}$, $V_{34}$, $V_{35}$, $V_{38}$, $V_{41}$, $V_{44}$, $V_{61}$ and $V_{64}$ preferably represents a hydrogen atom. $V_{32}$, $V_{36}$, $V_{42}$ and $V_{62}$ particularly preferably represent a chlorine atom, and $V_{33}$, $V_{37}$, $V_{43}$ and $V_{63}$ each represents particularly preferably a chlorine atom, a trifluoromethyl group or a cyano group.

Examples of the unsubstituted alkyl group represented by $W_{21}$ to $W_{24}$, $W_{41}$, $W_{42}$, $W_{51}$ and $W_{52}$ include a methyl group, an ethyl group. Examples of the substituted alkyl group include a benzyl group, and examples of the aryl group include a phenyl group and a naphthyl group. Further, a benzoxazole or naphthoxazole nucleus formed by $W_{21}$ and $W_{22}$, $W_{23}$ and $W_{24}$, $W_{41}$ and $W_{42}$, or $W_{51}$ and $W_{52}$, when they are combined, can include, for example, the following.

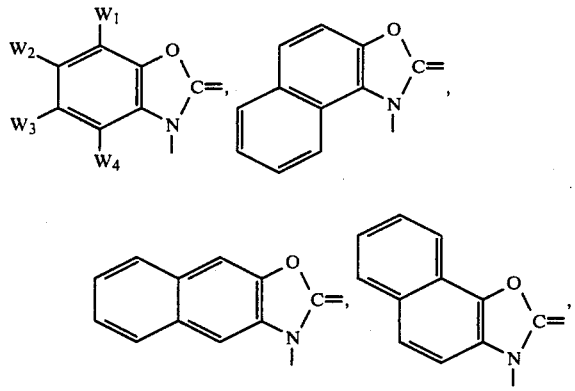

wherein $W_1$, $W_2$, $W_3$ and $W_4$ each represents a hydrogen atom, a halogen atom (e.g., a fluorine atom, a chlorine atom, a bromine atom or an iodine atom), an alkyl group (e.g., a methyl group or an ethyl group), an alkoxy group (e.g., a methoxy group or an ethoxy group), a hydroxy group, an acyloxy group (e.g., an acetoxy group) or an aryl group (e.g., a phenyl group).

$W_1$ and $W_4$ preferably represent a hydrogen atom.

$W_2$ preferably represents a hydrogen atom, a halogen atom or an alkyl group and, more preferably, a hydrogen atom.

$W_3$ preferably represents a halogen atom (particularly a chlorine atom), a phenyl group or an alkoxy group (particularly a methoxy group).

Compounds of general formula (III) also include proton-added compounds.

The hetero ring formed by $Z_{11}$, $Z_{12}$, $Z_{51}$, $Z_{61}$, $Z_{71}$, $Z_{72}$, $Z_{81}$ and $Z_{82}$ in general formulae (I) to (VIII) may be substituted by at least one substituent, including a halogen atom (e.g., a fluorine atom, a chlorine atom, a bromine atom or an iodine atom), a nitro group, an alkyl group (containing preferably 1 to 4 carbon atoms, e.g., a methyl group, an ethyl group, a trifluoromethyl group, a benzyl group or a phenethyl group), an aryl group (e.g., a phenyl group), an alkoxy group (containing preferably 1 to 4 carbon atoms, e.g., a methoxy group, an ethoxy group, a propoxy group or a butoxy group), a carboxyl group, an alkoxycarbonyl group (containing preferably 2 to 5 carbon atoms, e.g., an ethoxycarbonyl group), a hydroxy group or a cyano group.

With respect to $Z_{11}$, $Z_{12}$, $Z_{51}$, $Z_{61}$, $Z_{71}$, $Z_{72}$, $Z_{81}$ and $Z_{82}$, the benzothiazole nucleus includes, for example, a benzothiazole nucleus, a 4-chlorobenzothiazole nucleus, a 5-chlorobenzothiazole nucleus, a 6-chlorobenzothiazole nucleus, a 7-chlorobenzothiazole nucleus, a 5-nitrobenzothiazole nucleus, a 4-methylbenzothiazole nucleus, a 5-methylbenzothiazole nucleus, a 6-methylbenzothiazole nucleus, a 5-bromobenzothiazole nucleus, a 6-bromobenzothiazole nucleus, a 5-iodobenzothiazole nucleus, a 5-phenylbenzothiazole nucleus, a 5-methoxybenzothiazole nucleus, a 6-methoxybenzothiazole nucleus, a 5-ethoxybenzothiazole nucleus, a 5-propoxybenzothiazole nucleus, a 5-carboxybenzothiazole nucleus, a 5-ethoxycarbonylbenzothiazole nucleus, a 5-phenethylbenzothiazole nucleus, a 5-fluorobenzothiazole nucleus, a 5-chloro-6-methylbenzothiazole nucleus, a 5-trifluoromethylbenzothiazole nucleus, a 5,6-dimethylbenzothiazole nucleus and a 5-hydroxy-6-methylbenzothiazole nucleus; the naphthothiazole nucleus includes, for example, a naphtho[2,1-d]thiazole nucleus, a naphtho[1,2-d]thiazole nucleus, a naphtho[2,3-d]thiazole nucleus, a 5-methoxynaphtho[1,2-d]thiazole nucleus, a 7-ethoxynaphtho[2,1-d]thiazole nucleus and a 5-methoxynaphtho[2,3-d]thiazole nucleus; the benzoselenazole nucleus includes, for example, a benzoselenazole nucleus, a 5-chlorobenzoselenazole nucleus, a 5-nitrobenzoselenazole nucleus, a 5-methoxybenzoselenazole nucleus, a 5-ethoxybenzoselenazole nucleus, a 5-hydroxybenzoselenazole nucleus and a 5-chloro-6-methylbenzoselenazole nucleus; the naphthoselenazole nucleus includes, for example, a naphtho[1,2-d]selenazole nucleus and a naphtho[2,1-d]selenazole nucleus; the thiazole nucleus includes, for example, a thiazole nucleus, a 4-methylthiazole nucleus, a 4-phenylthiazole nucleus, a 4,5-dimethylthiazole nucleus and a 4,5-diphenylthiazole nucleus; and the thiazoline nucleus includes, for example, a thiazoline nucleus and a 4-methylthiazoline nucleus.

With respect to $Z_{71}$, $Z_{72}$, $Z_{81}$ and $Z_{82}$, the benzoxazole nucleus includes, for example, a benzoxazole nucleus, a 5-chlorobenzoxazole nucleus, a 5-methylbenzoxazole nucleus, a 5-bromobenzoxazole nucleus, a 5-fluorobenzoxazole nucleus, a 5-phenylbenzoxazole nucleus, a 5-methoxybenzoxazole nucleus, a 5-ethoxybenzoxazole nucleus, a 5-trifluoromethylbenzoxazole nucleus, a 5-hydroxybenzoxazole nucleus, a 5-carboxybenzoxazole nucleus, a 6-methylbenzoxazole nucleus, a 6-chlorobenzoxazole nucleus, a 6-methoxybenzoxazole nucleus, a 6-hydroxybenzoxazole nucleus and a 5,6-dimethylbenzoxazole nucleus; and the naphthoxazole nucleus includes, for example, a naphtho[2,1-d]oxazole nucleus, a naphtho[1,2-d]oxazole nucleus, a naphtho[2,3-d]oxazole nucleus and a 5-methoxynaphtho[1,2-d]oxazole nucleus.

Further, with respect to $Z_{71}$ and $Z_{72}$, the oxazole nucleus includes, for example, an oxazole nucleus, a 4-methyloxazole nucleus, a 4-ethyloxazole nucleus, a 4-phenyloxazole nucleus, a 4-benzyloxazole nucleus, a 4-methoxyoxazole nucleus, a 4,5-dimethyloxazole nucleus, a 5-phenyloxazole nucleus, and a 4-methoxyoxazole nucleus; the pyridine nucleus includes, for example, a 2-pyridine nucleus, a 4-pyridine nucleus, a 5-methyl-2-pyridine nucleus and a 3-methyl-4-pyridine nucleus; and the quinoline nucleus includes, for example, a 2-quinoline nucleus, a 4-quinoline nucleus, a 3-methyl-2-quinoline nucleus, a 5-ethyl-2-quinoline nucleus, a 6-methyl-2-quinoline nucleus, an 8-fluoro-4-quinoline nucleus, an 8-chloro-2-quinoline nucleus, an 8-fluoro-2-quinoline nucleus, a 6-methoxy-2-quinoline nucleus, a 6-ethoxy-4-quinoline nucleus, an 8-chloro-4-quinoline nucleus, an 8-methyl-4-quinoline nucleus and an 8-methoxy-4-quinoline nucleus.

The indoline nucleus represented by $Z_{61}$ includes, for example, a 3,3-dialkylindoline nucleus such as a 3,3-dimethylindoline nucleus, a 3,3-diethylindoline nucleus, a 3,3-dimethyl-5-cyanoindoline nucleus, a 3,3-dimethyl-6-nitroindoline nucleus, a 3,3-dimethyl-5-nitroindoline nucleus, a 3,3-dimethyl-5-methoxyindoline nucleus, a 3,3-dimethyl-5-methylindoline nucleus and a 3,3-dimethyl-5-chloroindoline nucleus.

The sensitizing dyes used together with compound (A) or (B) of the present invention are advantageously used in such amounts that the intrinsic sensitivity of the silver halide emulsion is not substantially decreased. Specifically, they are used in amounts of about $1.0\times10^{-5}$ to $1.0\times10^{-3}$ mol, and preferably about $4.0\times10^{-5}$ to $2\times10^{-4}$ mol, per mol of silver halide.

Specific examples of cyanine dyes to be used in the present invention are illustrated below, although the present invention is not to be construed as being limited thereto.

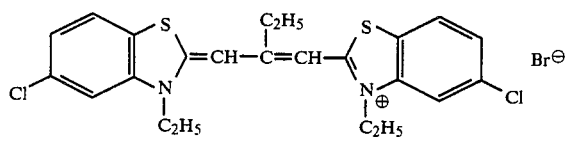
I-1

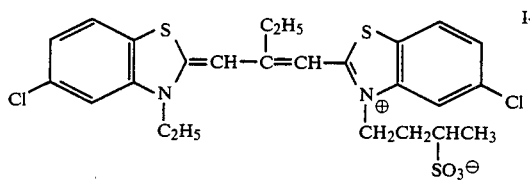
I-2

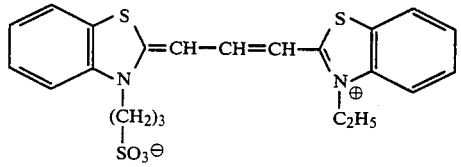
I-3

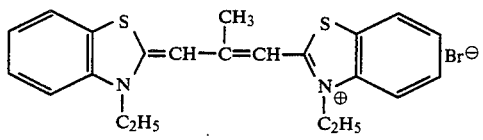
I-4

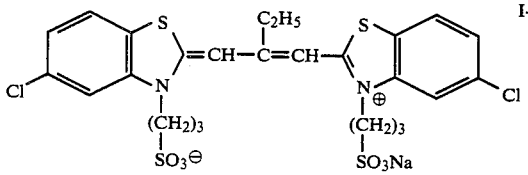
I-5

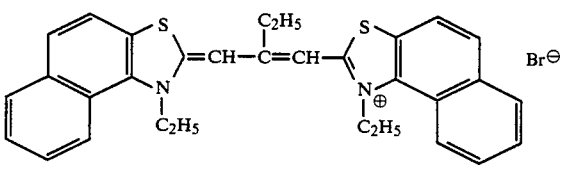
I-6

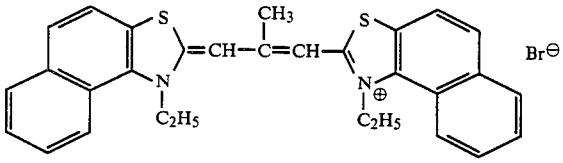
I-7

-continued
I-8
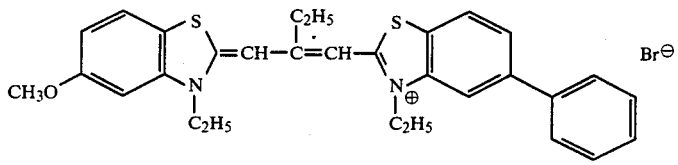
I-9
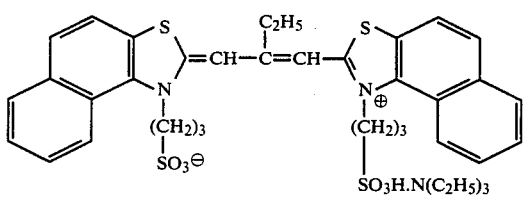
I-10
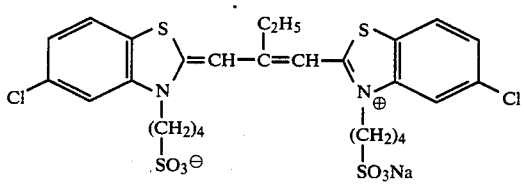
I-11
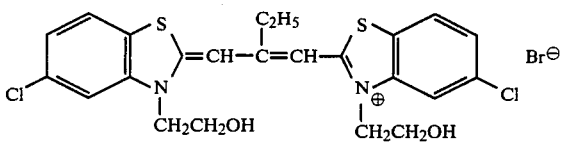
I-12
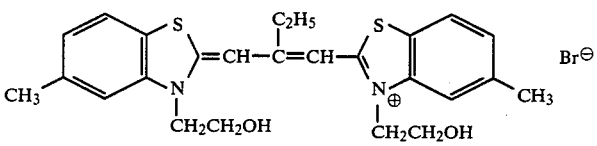
I-13
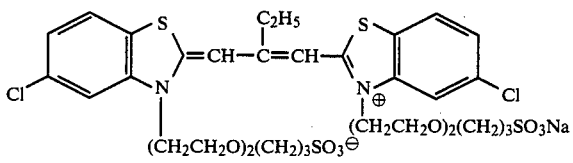
I-14
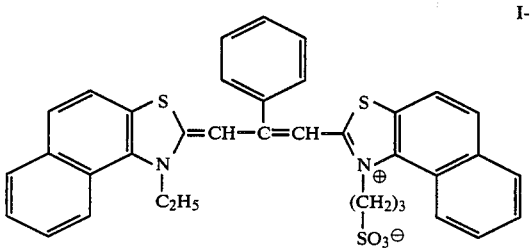
I-15
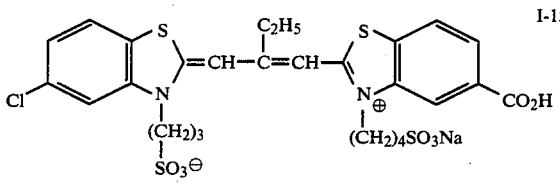
I-16
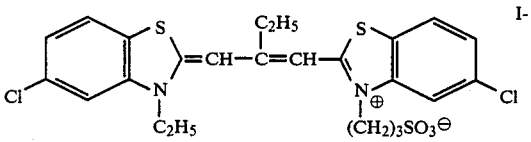
I-17
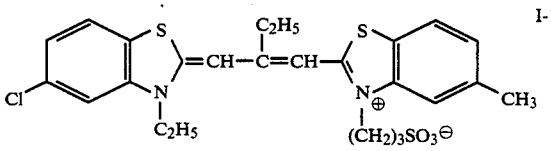
I-18
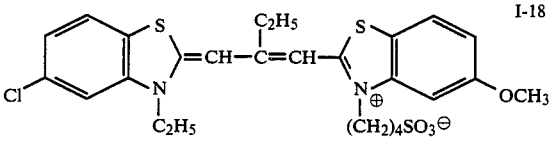
I-19
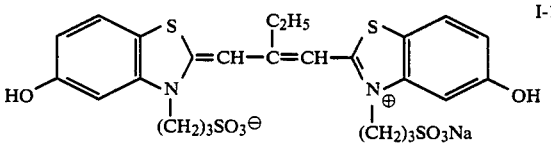

-continued
I-20
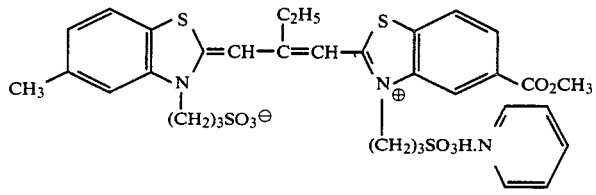
I-21
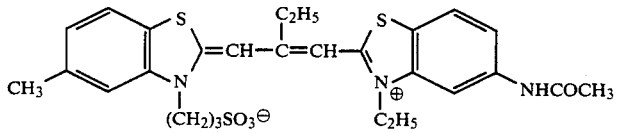
I-22
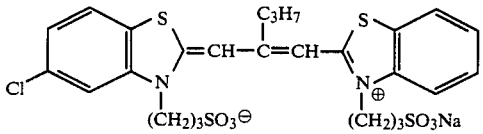
I-23
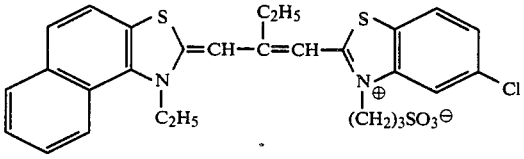
I-24
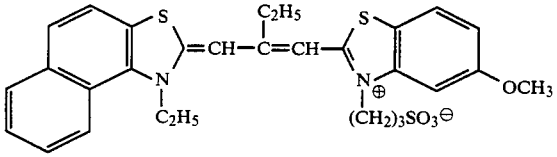
I-25
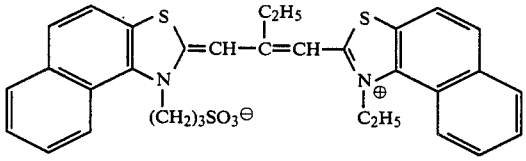
I-26
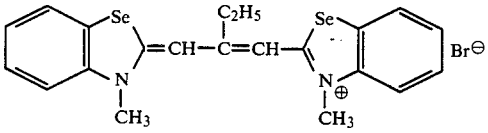
I-27
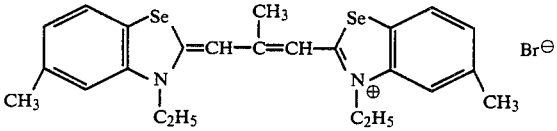
I-28
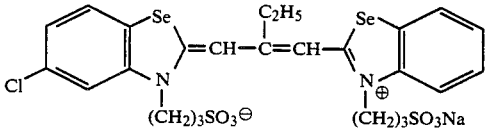
I-29
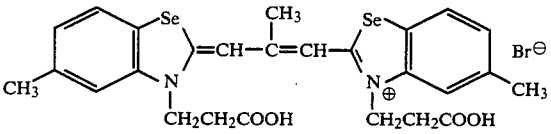
I-30
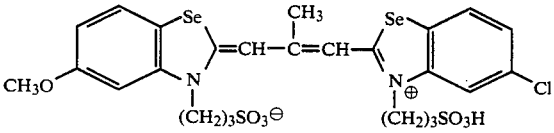
I-31
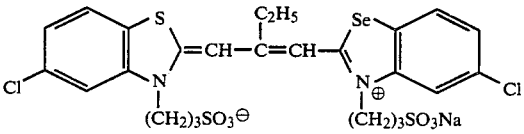
I-32
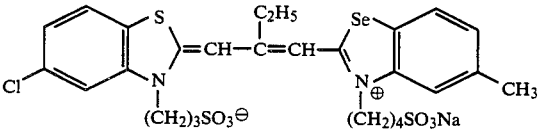
I-33
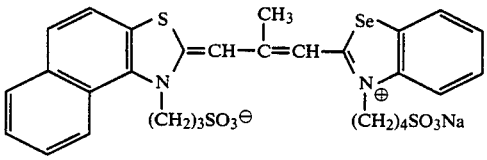
I-34
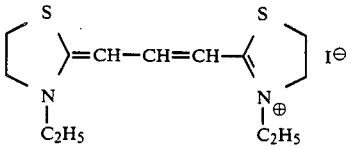

-continued
II-1
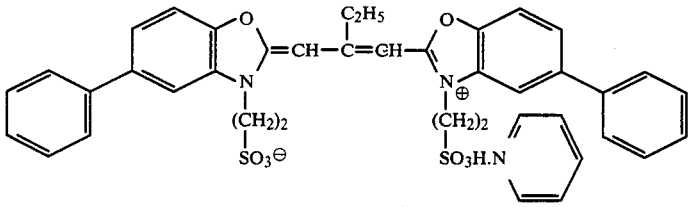
II-2
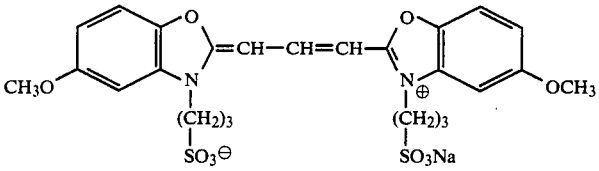
II-3
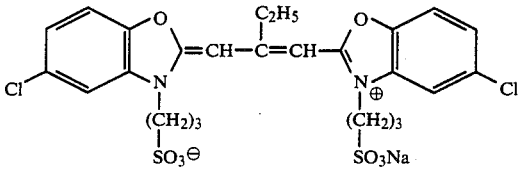
II-4
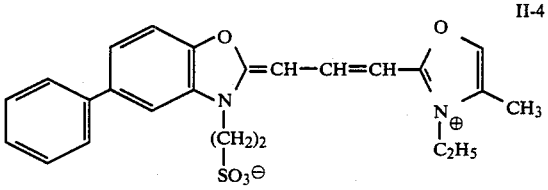
II-5
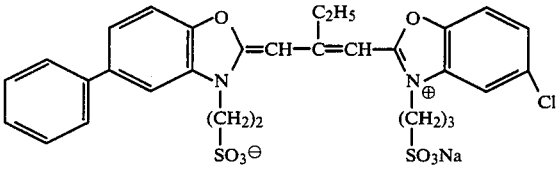
II-6
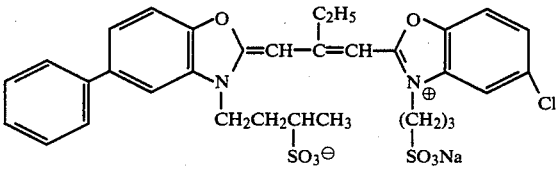
II-7
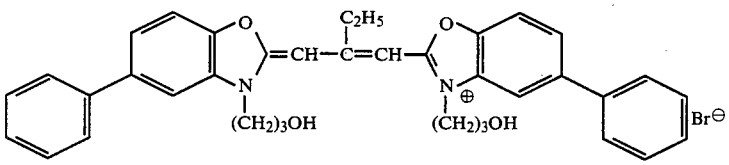
II-8
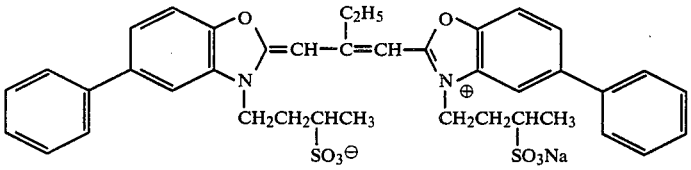
II-9
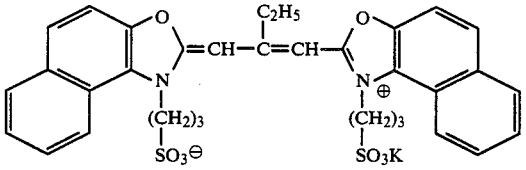
II-10
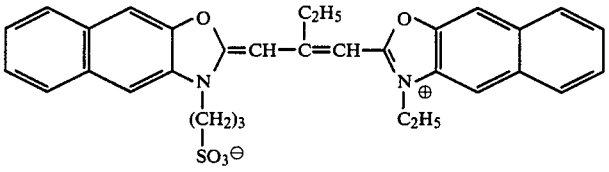
II-11
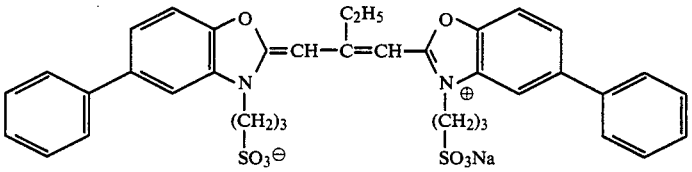

-continued
II-12
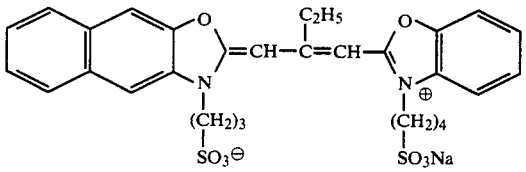
II-13
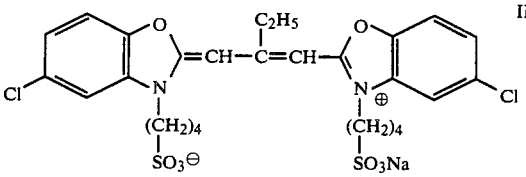
II-14
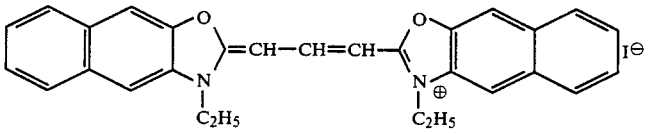
II-15
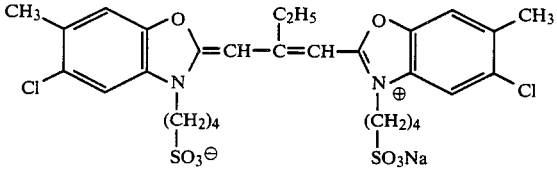
III-1
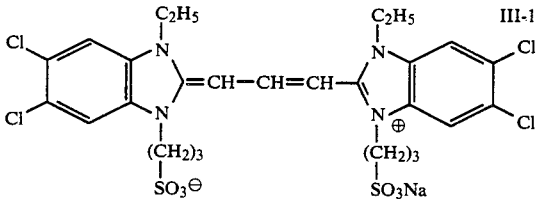
III-2
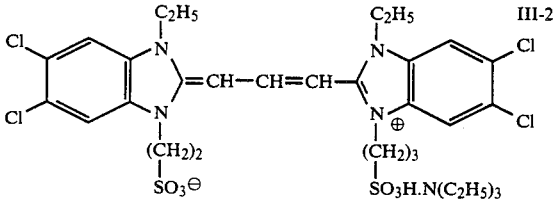
III-3
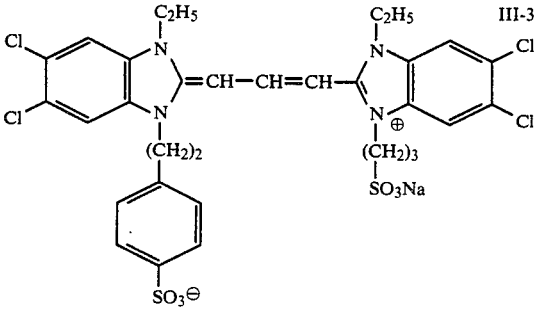
III-4
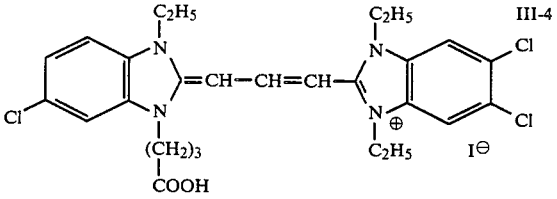
III-5
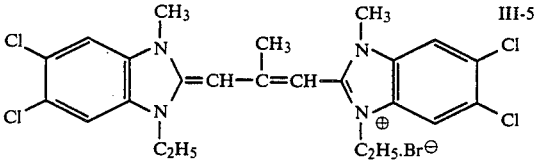
III-6
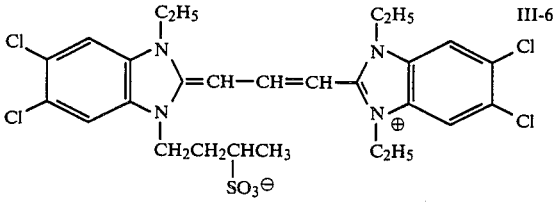
III-7
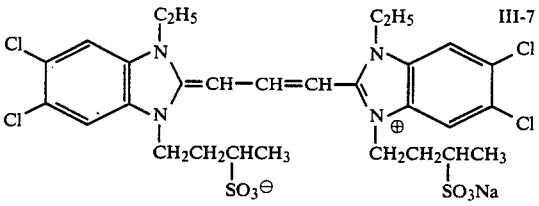
III-8
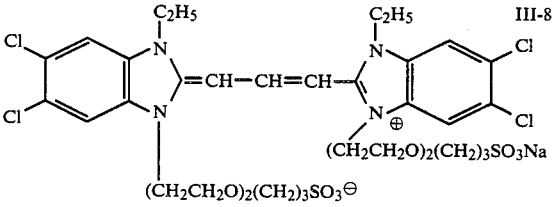
III-9
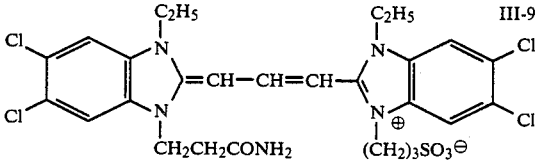

-continued
III-10
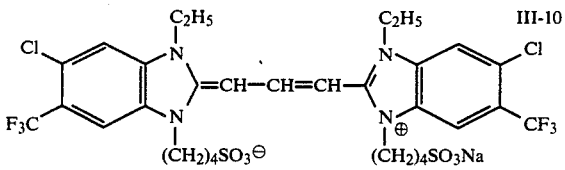
III-11
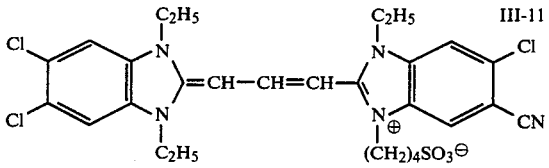
IV-1
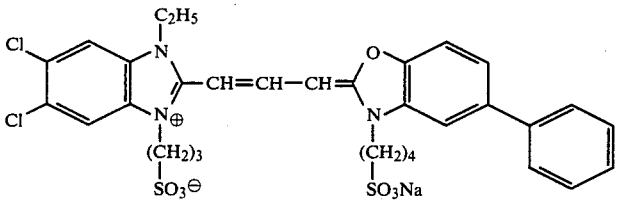
IV-2
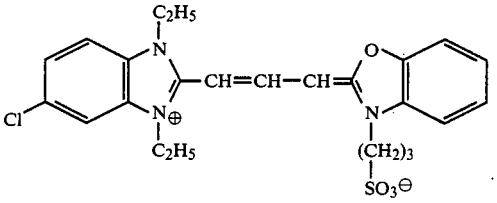
IV-3
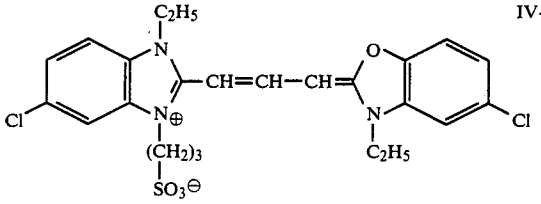
IV-4
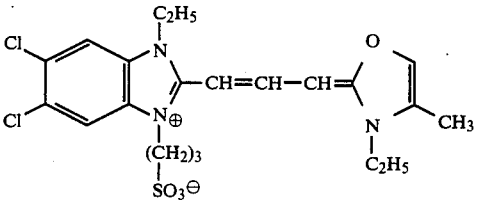
IV-5
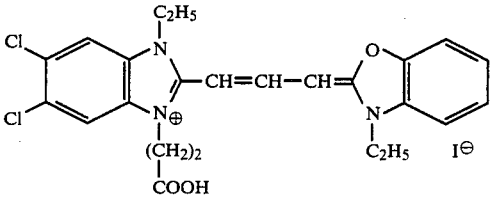
IV-6
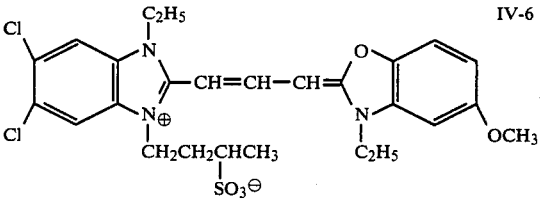
V-1
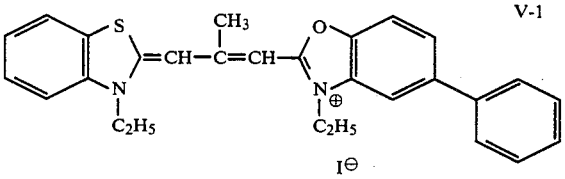
V-2
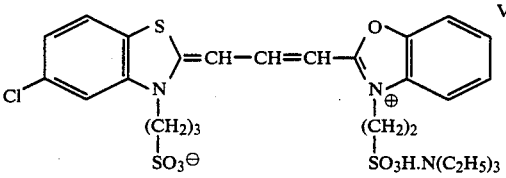
V-3
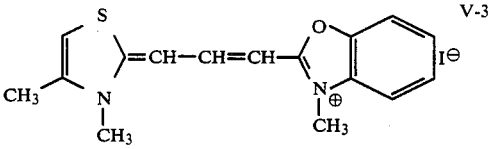
V-4
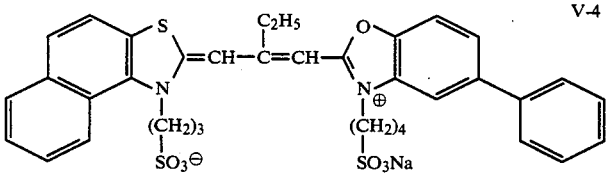
V-5
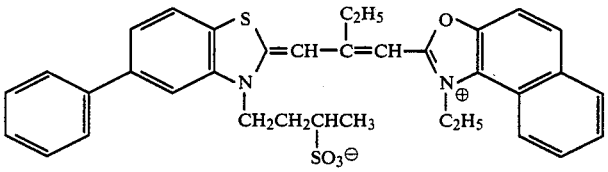

-continued
V-6
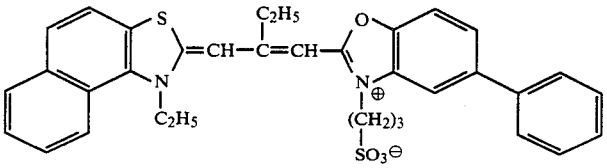
V-7
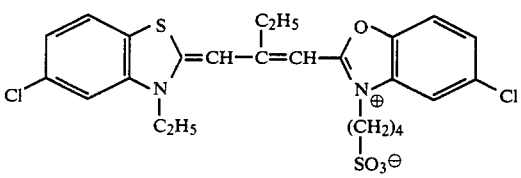
V-8
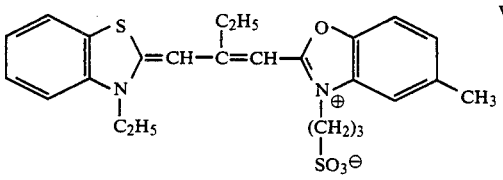
V-9
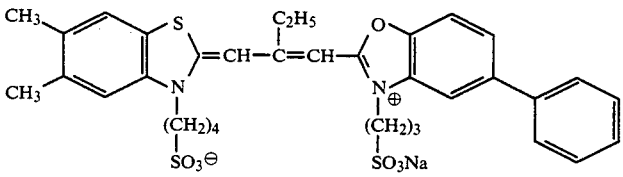
V-10
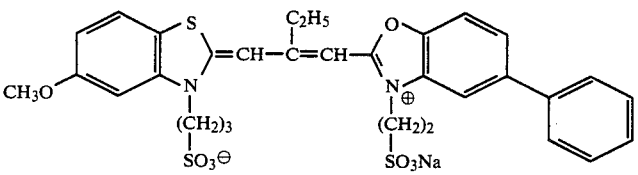
V-11
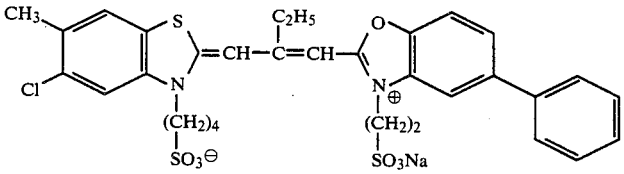
V-12
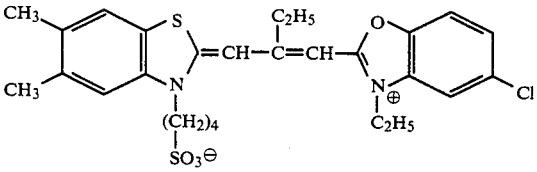
V-13
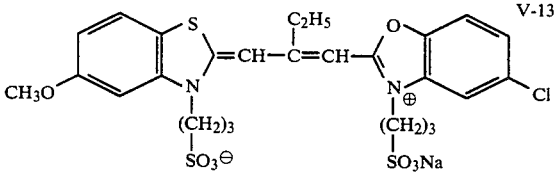
V-14
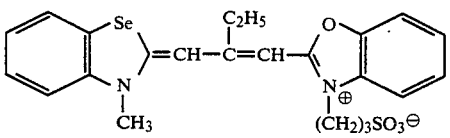
VI-1
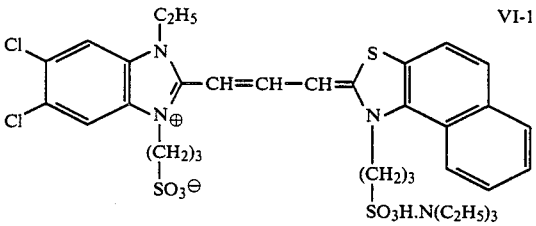
VI-2
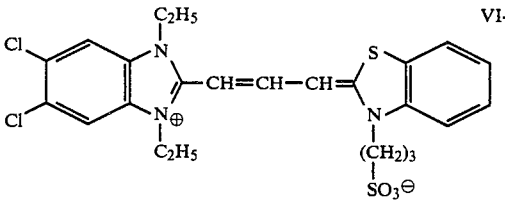

-continued
VI-3
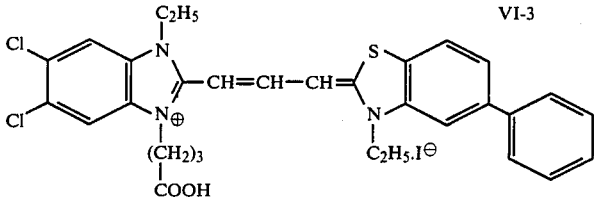
VI-4
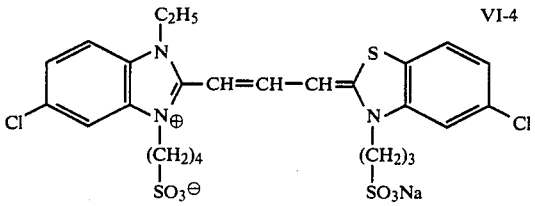
VI-5
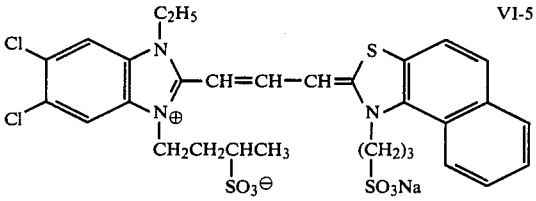
VI-6
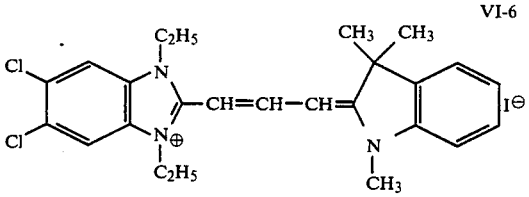
VI-7
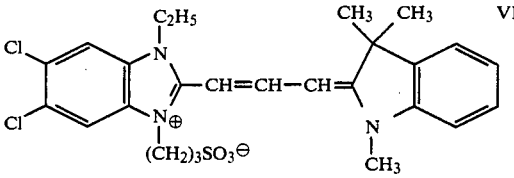
VI-8
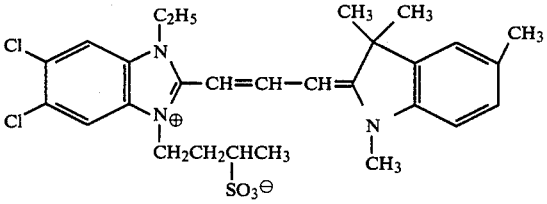
VII-1
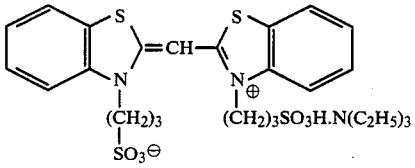
VII-2
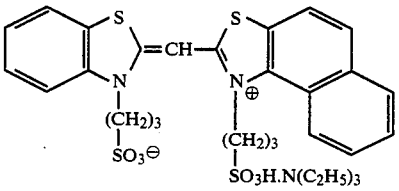
VII-3
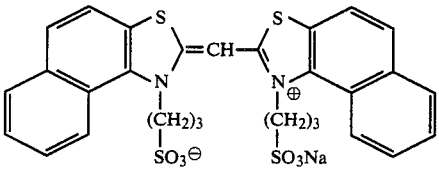
VII-4
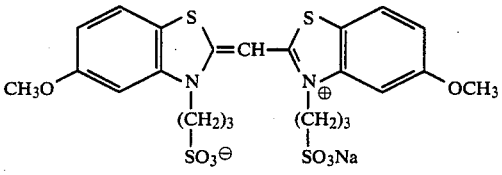
VII-5
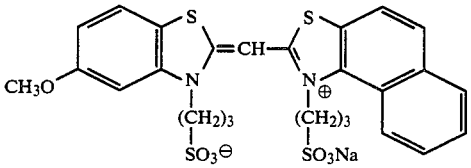
VII-6
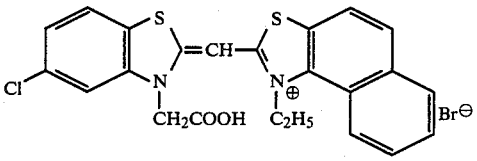
VII-7
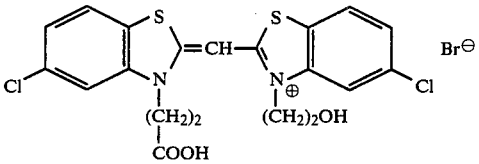
VII-8
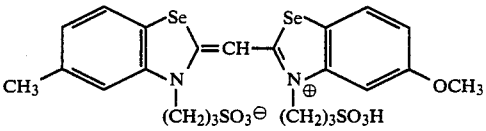
VII-9
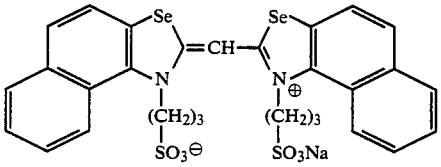
VII-10
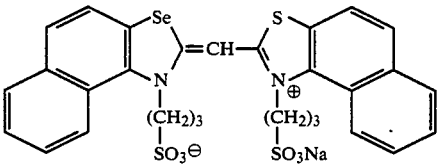

-continued
VII-11
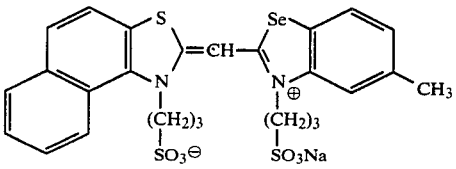
VII-12
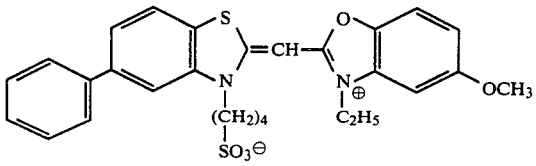
VII-13
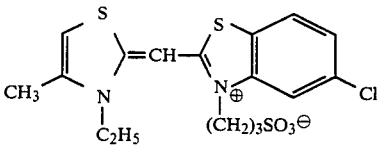
VII-14
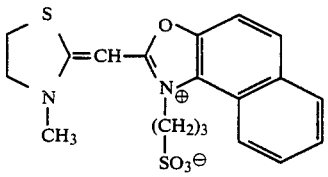
VII-15
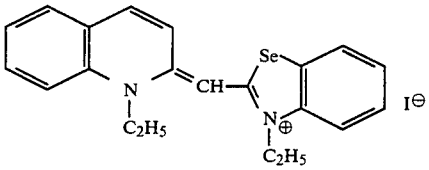
VII-16
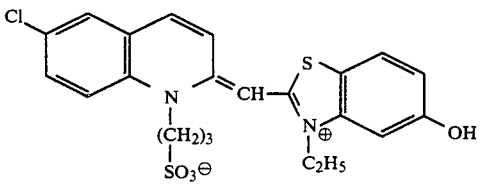
VII-17
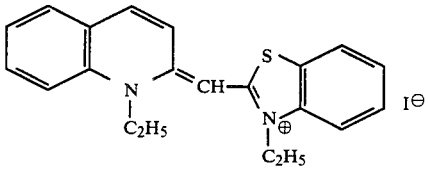
VII-18
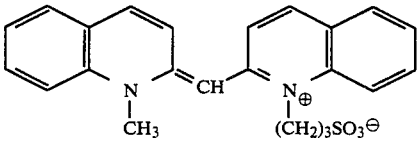
VII-19
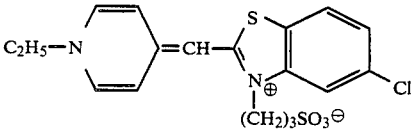
VII-20
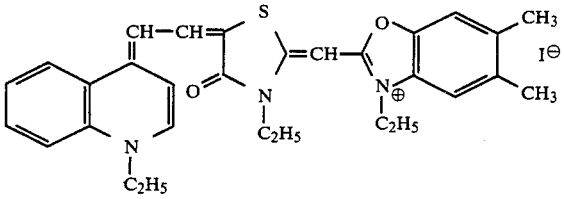
VII-21
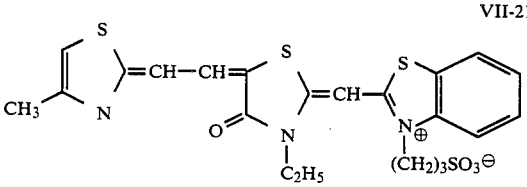
VII-22
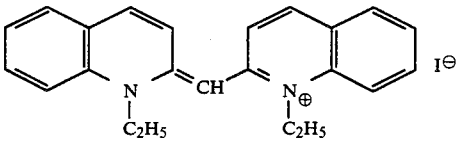
VIII-1
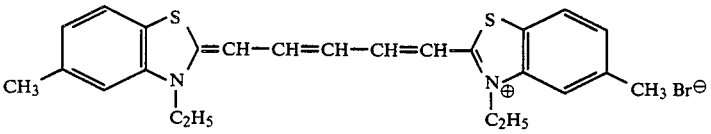
VIII-2
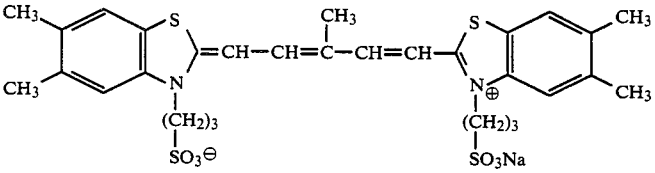

-continued

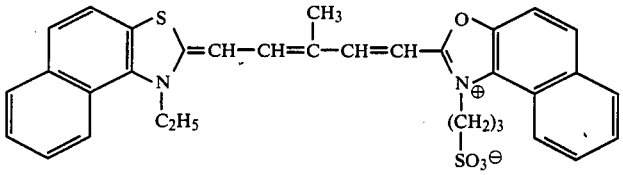

VIII-3

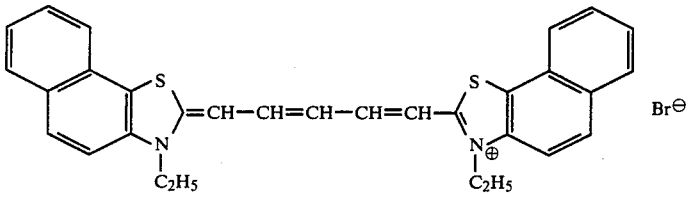

VIII-4

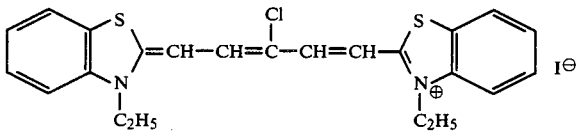

VIII-5

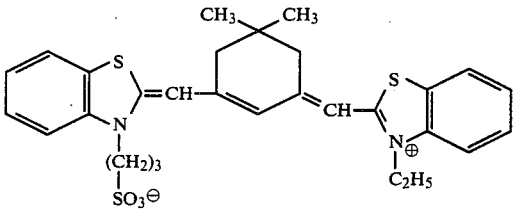

VIII-6

The sensitizing dyes represented by the foregoing general formulae (I) to (VIII) are described in U.S. Pat. Nos. 2,852,385, 2,694,638, 3,615,635, 2,912,329, 3,364,031, 3,397,060, 3,506,443 and British Pat. No. 1,339,833, and may be easily synthesized by those skilled in the art according to the above-described patents or F. M. Hamer, *The Cyanine Dyes and Related Compounds* (Interscience Publishers, New York, 1964). Those which are not described in these publications may also be easily synthesized from known starting materials in an analogous manner.

The ratio of the spectral sensitizing dye to the supersensitizing agent of the present invention, which may be properly determined through an ordinary emulsion test, is typically from about 1:10 to about 10:1 by mol.

The supersensitizing agent (A) or (B) used in the present invention may be incorporated in a hydrophilic colloidal layer adjacent to a silver halide emulsion layer, but, preferably, is incorporated in a silver halide emulsion layer together with the spectral sensitizing dye.

The silver halide photographic light-sensitive material of the present invention may be a light-sensitive material for photographing or for printing, and may be a "negative" light-sensitive material which forms a negative image by exposure to a positive subject or a direct positive light-sensitive material which directly forms a positive image without reversal processing. In addition, the light-sensitive material may be a black-and-white light-sensitive material (including light-sensitive materials for X-ray and for silver salt diffusion transfer processes) or a color light-sensitive material. The color light-sensitive materials to which the present invention is applicable include various materials such as "conventional" color light-sensitive materials using color couplers as dye image-providing compounds (hereinafter referred to as "color materials"), thermally developable color light-sensitive materials, and color diffusion transfer light-sensitive materials.

The silver halide emulsion to be used in the present invention is usually subjected to chemical sensitization, including sulfur sensitization using active gelatin or sulfur-containing compounds capable of reacting with silver (e.g., thiosulfates, thioureas, mercapto compounds and rhodanines), reduction sensitization using reductive substances (e.g., stannous salts, amines, hydrazine derivatives, formamidine-sulfinic acid and silane compounds), and noble metal sensitization using noble metals (e.g., gold complexes and complexes of the group VIII metals such as Pt, Ir, Pd), which can be employed alone or in combination.

As the silver halide composition to be employed in the present invention, typical examples include silver bromide, silver iodide, silver chloride, silver chlorobromide, silver bromoiodide, and silver chlorobromoiodide. Preferred silver halide emulsions contain at least 50 mol% silver bromide, and the most preferred emulsions are silver bromoiodide emulsions containing from about 0 to 10 mol% of silver iodide. Any conventional crystal form of silver halide grain including plate-like and regular grains (e.g., octahedral and cubic grains) may be used. As the plate-like grains, those with an aspect ratio of about 5 or more, and particularly about 8 or more, may also be used, such as, for example, those described in Japanese Patent Application (OPI) No. 108528/83 (U.S. Pat. Nos. 4,413,053 and 4,411,986).

The silver halide emulsion may form a latent image mainly on the surface of grains (i.e., "negative emulsion") or may form a latent image mainly inside the grains (i.e., "internal latent image-forming emulsion"

used as direct positive emulsions). The present invention is preferably applied to the direct positive emulsions.

The internal latent image-forming emulsion is characterized by providing greater maximum density when developed with an "internal" developing solution than that when developed with a "surface" developing solution.

The internal latent image-forming silver halide emulsions to which the present invention is applicable include, for example, conversion emulsions obtained by converting silver salt grains with high solubility such as silver chloride into silver salt grains with low solubility such as silver (iodo)bromide (a process of catastrophic precipitation) (described in, for example, U.S. Pat. No. 2,592,250); core/shell emulsions containing silver halide grains comprising core particles coated with a silver halide shell, prepared by mixing a core emulsion containing chemically sensitized large silver halide grains with a fine grain emulsion and ripening the resulting mixture (as described, for example, in U.S. Pat. No. 3,206,313); core/shell emulsions containing silver halide grains comprising core particles coated with a silver halide shell, prepared by simultaneously adding to a chemically sensitized monodisperse core emulsion, a solution of a soluble silver salt and a solution of a soluble halide while maintaining the silver ion concentration at a constant level (as described, for example, in British Pat. No. 1,027,146 and U.S. Pat. No. 3,761,276); halide-localized emulsions containing silver halide grains having a two or more layered structure wherein one layer differs from another in halide composition (for example, as described in U.S. Pat. No. 3,935,014); and emulsions containing foreign materials, prepared by producing silver halide grains in an acidic medium containing a trivalent metal ion (for example, as described in U.S. Pat. No. 3,447,927). In addition, internal latent image-forming emulsions may be used which are prepared according to processes described in E. J. Wall, *Photographic Emulsion,* pp. 35–36 and 52–53 (American Photographic Publishing Co., 1929), and U.S. Pat. Nos. 2,497,875, 2,563,785, 3,511,662, 4,395,478 and West German Patent Application (OLS) No. 2,728,108. Of the above-described internal latent image-forming emulsions, core/shell type emulsions are particularly suited for use in the present invention.

Typical nucleating agents useful in the present invention for internal latent image-forming emulsions include hydrazines described in U.S. Pat. Nos. 2,563,785 and 2,588,982, hydrazides and hydrazones described in U.S. Pat. No. 3,227,552, hetero ring quaternary salt compounds described in British Pat. No. 1,283,835, Japanese Patent Application (OPI) No. 69613/77, U.S. Pat. Nos. 3,615,615, 3,719,494, 3,734,738, 4,094,683 and 4,115,122, sensitizing dyes having nucleating substituents in the dye molecules described in U.S. Pat. No. 3,718,470, thiourea-bound acylhydrazine compounds described in U.S. Pat. Nos. 4,030,925, 4,031,127, 4,245,037, 4,255,511, 4,266,013, 4,276,364 and British Pat. No. 2,012,443, and acylhydrazine compounds having a thioamido ring or hetero ring such as triazole or tetrazole as an adsorptive group described in U.S. Pat. Nos. 4,080,270, 4,278,748 and British Pat. No. 2,011,391B.

The nucleating agents are desirably used in amounts which provide sufficient maximum density when internal latent image-forming emulsions containing the agents are developed in a surface developer. The amounts vary depending upon the characteristic properties of the silver halide emulsions, the chemical structure of the nucleating agents, and developing conditions, with proper amounts varying in a wide range. When added to a developing solution, they are generally used in amounts of about 0.01 g to about 5 g (preferably about 0.05 to 1 g) per liter of the developing solution. When added to an emulsion layer, they are generally added in amounts of about 0.1 mg to about 5 g per mol of silver in an internal latent image-forming emulsion and preferably in a range of from about 0.5 mg to about 2 g per mol of silver. When incorporated in a hydrophilic colloidal layer adjacent to the emulsion layer, they may be incorporated in approximately the same amounts as described above, based on the amount of silver contained in an equal area of the internal latent image-forming emulsion.

To the silver halide photographic emulsion used in the present invention, various compounds may be added for the purpose of preventing formation of fog and for stabilizing photographic properties during storage or photographic processing. Typical antifoggants or stabilizers include azoles (e.g., benzothiazolium salts, nitroindazoles, triazoles, benzotriazoles, benzimidazoles (particularly, nitro- or halogen-substituted benzimidazoles)); heterocyclic mercapto compounds (e.g., mercaptothiazoles, mercaptobenzothiazoles, mercaptobenzimidazoles, mercaptothiadiazoles, mercaptotetrazoles (particularly, 1-phenyl-5-mercaptotetrazole), mercaptopyrimidines); the above-described heterocyclic mercapto compounds having a water-soluble group such as a carboxyl group or a sulfo group; thioketo compounds (e.g., oxazolinethiones); azaindenes (e.g., tetraazaindenes and particularly 4-hydroxy-substituted (1,3,3a,7-)tetraazaindenes); benzenethiosulfonic acids; and benzenesulfinic acids.

The photographic light-sensitive material of the present invention may contain in its photographic emulsion layers or other hydrophilic colloidal layers various known surfactants for various purposes such as improvement of coating properties, antistatic properties, slip properties, emulsion dispersibility, anti-adhesion properties, and photographic properties (for example, development acceleration, realization of high contrast, sensitization, etc.).

Surfactants which are useful include, for example, nonionic surface active agents such as saponins (steroid type), alkylene oxide derivatives (e.g., polyethylene glycol, polyethylene glycol/polypropylene glycol condensate, polyethylene glycol alkyl ethers or polyethylene glycol alkylaryl ethers, polyethylene glycol esters, polyethylene glycol sorbitan esters, polyalkylene glycol alkylamine or amides, or silicone/polyethylene oxide adducts), glycidol derivatives (e.g., alkenylsuccinic acid polyglyceride, or alkylphenol polyglyceride), polyhydric alcohol fatty acid esters, and sugar alkyl esters; anionic surface active agents having an acidic group such as a carboxy group, a sulfo group, a phospho group, a sulfuric ester group or a phosphoric ester group (e.g., alkylcarboxylates, alkylsulfonates, alkylbenzenesulfonates, alkylnaphthalenesulfonates, alkylsulfuric esters, alkyl phosphates, N-acyl-N-alkyltaurines, sulfosuccinates, sulfoalkyl polyoxyethylene alkylphenyl ethers, or polyoxyethylene alkyl phosphates); amphoteric surface active agents such as amino acids, aminoalkylsulfonic acids, aminoalkyl sulfates or phosphates, alkylbetaines, and amine oxides; and cationic surface active agents such as alkylamines, aliphatic or aromatic quaternary ammonium salts, hetero ring quaternary ammonium salts (e.g., pyridinium or imidazolium), aliphatic or heterocyclic phosphonium or sulfonium salts.

The color materials usable in the light-sensitive material of the present invention include couplers such as the magenta color-forming couplers described in U.S. Pat. Nos. 2,600,788, 2,983,608, 3,062,653, 3,127,269, 3,311,476, 3,419,391, 3,519,429, 3,558,319, 3,582,322, 3,615,506, 3,834,908, 3,891,445, West German Patent Application (OLS) Nos. 2,408,665, 2,417,945, 2,418,959, 2,424,467, Japanese Patent Publication Nos. 6031/65, 58922/77, 129538/74, 74027/74, 159336/75, 42121/77, 74028/74, 60233/75, 26541/76 and 55122/78.

Specific examples of yellow color-forming couplers are described in U.S. Pat. Nos. 2,875,057, 3,265,506, 3,408,194, 3,551,155, 3,582,322, 3,725,072, 3,891,445, West German Pat. No. 1,547,868, West German Patent Application (OLS) Nos. 2,219,917, 2,261,361, 2,414,006, British Pat. No. 1,425,020, Japanese Patent Publication No. 10783/76, Japanese Patent Application (OPI) Nos. 26133/72, 73147/73, 102636/76, 6341/75, 123342/75, 130442/75, 21827/76, 87650/75, 82424/77 and 115219/77.

Specific examples of cyan couplers are described in U.S. Pat. Nos. 2,369,929, 2,434,272, 2,474,293, 2,521,908, 2,895,826, 3,034,892, 3,311,476, 3,458,315, 3,476,563, 3,583,971, 3,591,383, 3,767,411, 4,004,929, West German Patent Application (OLS) Nos. 2,414,830, 2,454,329, Japanese Patent Application (OPI) Nos. 59838/73, 26034/76, 5055/73, 146828/76, 69624/77 and 90932/77.

When using the light-sensitive material of the present invention in a color diffusion transfer process, dye developers may be used as color materials, including those which themselves are non-diffusible (immobile) in an alkaline solution (developing solution) but which as a result of development release a diffusible dye (or its precursor). Diffusible dye-releasing color materials include diffusible dye-releasing couplers and redox compounds, which are useful both in the color diffusion transfer process (wet process) and in the thermal recording process (dry process) as well.

The diffusible dye-releasing redox compounds (hereinafter referred to as "DRR compounds") are prepresented by the following general formula:

Y—D wherein Y represents a redox center capable of releasing a diffusible dye as a result of development and usually having a ballast group for immobilizing the compound, and D represents a dye (or its precursor) moiety which may be bound to the redox center through a linkage group.

Specific examples of Y are described in U.S. Pat. Nos. 3,928,312, 3,993,638, 4,076,529, 4,152,153, 4,055,428, 4,053,312, 4,198,235, 4,179,291, 4,149,892, 3,844,785, 3,443,943, 3,751,406, 3,443,939, 3,443,940, 3,628,952, 3,980,479, 4,183,753, 4,142,891, 4,278,750, 4,139,379, 4,218,368, 3,421,964, 4,199,355, 4,199,354, 4,278,750, 4,135,929, 4,336,322, 4,139,389, Japanese Patent Application (OPI) Nos. 50736/78, 104343/76, 130122/79, 110827/78, 12642/81, 16131/81, 4043/82, 650/82, 20735/82, 69033/78 and 130927/79.

As to the dye moiety represented by D, examples of yellow dye are described in U.S. Pat. Nos. 3,597,200, 3,309,199, 4,013,633, 4,245,028, 4,156,609, 4,139,383, 4,195,992, 4,148,641, 4,148,643, 4,336,322, Japanese Patent Application (OPI) Nos. 114930/76 and 71072/81, *Research Disclosure,* 17630 (1978), and *Research Disclosure,* 16475 (1977); examples of magenta dye are described in U.S. Pat. Nos. 3,453,107, 3,544,545, 3,932,380, 3,931,144, 3,932,308, 3,954,476, 4,233,237, 4,255,509, 4,250,246, 4,142,891, 4,207,104 and 4,287,292, Japanese Patent Application (OPI) Nos. 106727/77, 23628/77, 36804/80, 73057/81, 71060/81 and 134/80; and examples of cyan dye are described in U.S. Pat. Nos. 3,482,972, 3,929,760, 4,013,635, 4,268,625, 4,171,220, 4,242,435, 4,142,891, 4,195,994, 4,147,544 and 4,148,642, British Pat. No. 1,551,138, Japanese Patent Application (OPI) Nos. 99431/79, 8827/77, 47823/78, 143323/78, 99431/79, 71061/81, European Patent (EPC) Nos. 53037 and 53040, *Research Disclosure,* 17630 (1978) and *Research Disclosure,* 16475 (1977).

These compounds are generally caoted in amounts of about $1\times10^{-4}$ to about $1\times10^{-2}$ mol/m$^2$, preferably $2\times10^{-4}$ to $2\times10^{-3}$ mol/m$^2$.

As the support for the light-sensitive material of the present invention, any conventional material may be used. The silver halide emulsion may be coated on one side or both sides of the support.

Further, in the present invention, silver halide emulsions may contain compounds capable of releasing iodide ion (for example, potassium iodide), and images may be obtained by using a developer containing iodide ion.

An alkaline processing composition (developer) to be used in the present invention may contain preservatives such as sodium sulfite, potassium sulfite, ascorbic acid, and reductones (e.g., piperidinohexose reductone).

The developer may contain alkali agents and fubbers, including sodium hydroxide, potassium hydroxide, sodium carbonate, potassium carbonate, trisodium phosphate, and sodium metaborate. These agents are incorporated in amounts such that pH of the resulting developer is from about 10 to 14, preferably from about 12 to 14. The developer can advantageously contain a color development accelerator such as benzyl alcohol and conventional antifoggants such as benzimidazoles (e.g., 5-nitrobenzimidazole), and benzotriazoles (e.g., benzotriazole or 5-methylbenzotriazole) to reduce the minimum density of the direct positive image.

In developing the light-sensitive material of the present invention, various known developing agents may be used, including polyhydroxybenzenes such as hydroquinone, 2-chlorohydroquinone, 2-methylhydroquinone, catechol and pyrogallol; aminophenols such as p-aminophenol, N-methyl-p-aminophenol and 2,4-diaminophenol; 3-pyrazolidones such as 1-phenyl-3-pyrazolidone, 4,4-dimethyl-1-phenyl-3-pyrazolidone, 4,4-dihydroxymethyl-1-phenyl-3-pyrazolidone, 4-methyl-4-hydroxymethyl-1-phenyl-3-pyrazolidone and 4-methyl-4-hydroxymethyl-1-p-tolyl-3-pyrazolidone; and ascorbic acids; which may be used alone or in combination. In order to obtain dye images from dye-forming couplers, aromatic primary amine developing agents, preferably p-phenylenediamine developing agents, may be used, including 4-amino-3-methyl-N,N-diethylaniline hydrochloride, N,N-diethyl-p-phenylenediamine, 3-methyl-4-amino-N-ethyl-N-β-(methanesulfoamido)ethylaniline, 3-methyl-4-amino-N-ethyl-N-(β-sulfoethyl)aniline, 3-ethoxy-4-amino-N-ethyl-N-(β-sulfoethyl)aniline, and 4-amino-N-ethyl-N-(β-hydroxyethyl)aniline. Such developing agents may be incorporated in an alkaline processing composition (processing element) or in a suitable layer of the light-sensitive material.

In using DRR compounds in the present invention, any silver halide developing agent (or electron donor) may be used that can cross-oxidize the DRR compounds, with 3-pyrazolidone being particularly preferred.

In using the light-sensitive material of the present invention as a color diffusion transfer process film unit, it is preferably processed with a viscous liquid developer. This viscous developer is a processing composition containing processing ingredients necessary for developing a silver halide emulsion and for forming a diffusion transfer dye image. A major component of the developer is water or water and hydrophilic solvents such as methanol and methyl cellosolve. The processing composition contains a sufficient amount of alkali to keep the pH at the level necessary to develop the emulsion layer and to neutralize acids produced during development and dye image formation (for example, hydrohalogenic acids such as hydrobromic acid, carboxylic acids such as acetic acid, etc.). Useful alkalis include lithium hydroxide, sodium hydroxide, potassium hydroxide, calcium hydroxide dispersion, tetramethylammonium hydroxide, sodium carbonate, trisodium phosphate, alkali metal salts or alkaline earth metal salts of diethylamine or the like, and amines. Preferably, caustic alkali is used in an amount providing a pH of about 12 or more at room temperature (particularly a pH of 14 or more). More preferably, the processing composition also contains a hydrophilic polymer such as polyvinyl alcohol, hydroxyethyl cellulose, sodium carboxymethyl cellulose, which gives the resulting processing composition a viscosity of 1 poise or more, preferably about 500 to 1,000 poises, at room temperature.

The processing composition may contain, in addition, carbon black as a light barrier to prevent the silver halide emulsion from being fogged during or after photographic processing, a light absorbent such as a pH-indicating dye, and a desensitizer as described in U.S. Pat. No. 3,579,333, which is particularly advantageous with mono-sheet film units. Further, development restrainers such as benzotriazole may be added to the processing composition.

The above-described processing composition is preferably retained in a rupturable pod such as described in U.S. Pat. Nos. 2,543,181, 2,643,886, 2,653,732, 2,723,051, 3,056,491, 3,056,492 qnd 3,152,515.

Color photographic pictures can be obtained by using the light-sensitive material of the present invention as follows. A light-sensitive material (or a light-sensitive element) comprising a support having coated thereon at least one silver halide emulsion layer (containing an optical sensitizing dye and a super-sensitizing agent of the present invention) associated with at least one color material is imagewise exposed.

Subsequently, it is processed with an alkaline processing composition in the presence of a developing agent (electron-transferring agent) or is heated to develop the exposed silver halide emulsion. As a result of the development of the silver halide emulsion, a dye image is formed.

In a color diffusion transfer process, (a) an imagewise distribution of a diffusible dye is formed, and then (b) at least part of the dye is diffused (transferred) to an image-receiving layer (or image-receiving element) to obtain a diffusion transferred color image in the image-receiving layer.

In addition, a color photographic picture can be obtained in the same manner as described above using dye remaining in the light-sensitive material (or light-sensitive element).

In this method a color image comprising a non-diffusible dye (or color material) remaining in the light-sensitive material can be obtained by removing all diffusible dye formed in step (b) described above by washing with water or diffusion transfer and removing the remaining silver and silver halide by bleaching and fixing (which may be conducted simultaneously).

As is described above, the light-sensitive material of the present invention essentially comprises a light-sensitive element (1) comprising a support having coated thereon at least one silver halide emulsion layer. However, embodiments wherein (1) is combined with image-receiving element (or image-receiving layer) (2) are also included in the present invention. Further, light-sensitive materials comprising (1), (2), and (3) a means for supplying a processing composition are also included in the scope of the present invention.

In the embodiments having (1), (2) and (3) described above, a pressure-rupturable pod retaining the processing composition may be used as a means for supplying the processing composition. This pod is so disposed that, when pressure is applied thereto by pressure-applying members, the contents in the pod (processing composition) are spread, for example, between a light-sensitive layer and a cover sheet or between a light-sensitive layer and an image-receiving layer.

This image-receiving layer may be formed on a different support so as to be superimposed on a light-sensitive element after imagewise exposure. Such an embodiment is described in, for example, U.S. Pat. No. 3,362,819. As a modification thereof, the image-receiving element may be superimposed on a light-sensitive element forming an integrated unit before, during and after exposure.

As another embodiment, the image-receiving element may be provided on the same support as that of light-sensitive element. Such a unified embodiment (film unit) is described in, for example, Belgian Pat. No. 757,960, and a modification thereof id disclosed in Belgian Pat. No. 757,959. In this embodiment, a transparent support is used, at least an image-receiving layer, a light-reflecting layer (white layer), a light barrier layer, and a light-sensitive element are coated on the support, and a rupturable pod retaining an alkaline processing composition and a light barrier agent is provided between the uppermost layer (protective layer) of the light-sensitive element and a transparent cover sheet (coated with a neutralizing layer and a timing layer). This film unit is loaded in a camera, exposed through the transparent cover sheet, then, upon withdrawal of the unit out of the camera, is passed between a pair of pressure-applying members in the camera. The pod is ruptured by the pressure-applying members to spread the processing composition and the light barrier agent on the light-sensitive element. Each silver halide emulsion is developed with the processing composition, and diffusible dyes thus formed imagewise diffuse into the image-receiving layer to form a transferred image therein. Thus, a color photographic picture can be seen against the background of the light-reflecting layer (white layer).

As a modification of the unit embodiment, a delamination layer may be provided between the image-receiving layer and the light-sensitive element, which enables a photographer to produce an ordinary color print or color slide by delamination after formation of the transferred image.

The present invention will now be described in more detail by the following examples of preferred embodiments of the present invention, but the present invention is not to be construed as being limited thereto. Unless othewise indicated, all parts, percents and ratios are by weight.

EXAMPLE 1

A control silver bromide emulsion (having a [1 0 0] face) was prepared in a conventional manner. That is, equimolar amounts of an aqueous solution of silver nitrate and an aqueous solution of potassium bromide were simultaneously added to an aqueous solution containing gelatin at 50° C. by a double jet process to obtain the silver bromide emulsion. During the processing, a potential of Ag was controlled to maintain +50 mV with respect to a calomel electrode. A spectrally sensitized emulsion was prepared by adding Sensitizing Dye VII-22 in a predetermined amount (see Table 1) to 1 kg of the same emulsion. Further, spectrally sensitized emulsions were prepared by adding a predetermined amount of Sensitizing Dye VII-22 and a predetermined amount of Supersensitizing Agent (1) or (16) (see Table 1) to the above-described control silver bromide emulsion. Each of these emulsions was coated on a triacetate film, then dried to obtain photographic light-sensitive materials.

They were exposed through an optical wedge (for 0.1 second) at 3,200 lx using a yellow filter (SC-46, made by Fuji Photo Film Co., Ltd.).

Each sample was developed at 20° C. for 5 minutes using a developer of the following formulation, then subjected to conventional stopping, fixing, and washing steps to obtain strips having a predetermined black-and-white image. The image densities were measured using a TCD-model densitometer made by Fuji Photo Film Co., Ltd. to obtain yellow filter sensitivity ($S_\gamma$) and fog value. The sensitivities are given in Table 1 as relative values taking [fog+0.1] as a base optical density for determining sensitivity.

| Formulation of the Developer: | |
|---|---|
| Water | 500 ml |
| Metol | 2 g |
| Anhydrous Sodium Sulfite | 90 g |
| Hydroquinone | 8 g |
| Sodium Carbonate Monohydrate | 52.5 g |
| Potassium Bromide | 5 g |
| Water to make | 1 liter |

Comparison of spectral sensitivities given in Table 1 clearly shows that combined use of the supersensitizing agent of the present invention and a spectral sensitizing dye remarkably enhances the degree of spectral sensitization provided by the spectral sensitizing dye (i.e., the supersensitizing effect).

TABLE 1

| No. | Sensitizing Dye ($\times 10^{-5}$ mol/kg emulsion) | Supersensitizing Agent ($\times 10^{-6}$ mol/kg emulsion) | Spectral Sensitivity ($S_\gamma$) | Fog Density | Note |
|---|---|---|---|---|---|
| 1 | VII-22 (9.5) | — | 100 (base) | 0.04 | Comparison |
| 2 | " | Compound 1 (38) | 410 | " | Invention |
| 3 | " | Compound 16 (38) | 468 | " | Invention |
| 4 | " | Compound 41 (38) | 174 | " | Invention |

Sensitizing Dye VII-22 and Supersensitizing Agents (1), (16) and (41) are the compounds illustrated above as specific examples of the compounds usable in the present invention. In the following examples compounds according to the present invention are referred to in the same manner.

EXAMPLE 2

A control silver bromide emulsion (having a [1 1 1] face) was prepared in a conventional manner. That is, equimolar amounts of an aqueous solution of silver nitrate and an aqueous solution of potassium bromide were simultaneously added to an aqueous solution of gelatin at 50° C. by a double jet process to obtain the silver bromide emulsion. During the processing, a potential of Ag was controlled to maintain −30 mV with respect to a calomel electrode. A spectrally sensitized emulsion was prepared by adding a predetermined amount of a sensitizing dye (see Table 2) to 1 kg of the same emulsion. Other spectrally sensitized emulsions were prepared by similarly adding a predetermined amount of a spectral sensitizing dye and a predetermined amount of Supersensitizing Agent (1) or (16) of the present invention. Each of these emulsions was coated on a triacetate support, and dried to obtain photographic light-sensitive materials. They were exposed and processed, and then subjected to the same sensitometry as in Example 1 to obtain spectral sensitivity and fog value. The sensitivities are given in Table 2 as relative values taking [fog+0.10] as a base optical density for determining sensitivity.

Comparison of spectral sensitivities given in Table 2 clearly reveals that the spectral sensitivity attained by the spectral sensitizing dye is markedly enhanced by the combined use of the dye and the supersensitizing agent of the present invention.

TABLE 2

| No. | Sensitizing Dye ($\times 10^{-5}$ mol/kg emulsion) | Supersensitizing Agent ($\times 10^{-6}$ mol/kg emulsion) | Spectral Sensitivity ($S_\gamma$) | Fog Density | Note |
|---|---|---|---|---|---|
| 1 | Compound VII-22 (9.5) | — | 100 (base) | 0.05 | Comparison |
| 2 | " | Compound 1 (38) | 417 | " | Invention |
| 3 | " | Compound 16 (19) | 251 | " | Invention |

EXAMPLE 3

A control silver chlorobromide emulsion (silver halide emulsion having a [1.0.0.] face and comprising 70 mol % of silver chloride and 30 mol% of silver bromide mean grain size of silver halide grains: 0.34μ; silver halide content in 1 kg of emulsion: 1.03 mols) was prepared in a conventional manner as described in Example 1 above. A spectrally sensitized emulsion was prepared by adding a predetermined amount of a sensitizing dye to 1 kg of the same emulsion, and another spectrally sensitized emulsion was prepared by adding a predetermined amount of a sensitizing dye and a supersensitizing agent of the present invention to the same emulsion. Each of these emulsions was coated on a triacetate support and dried to obtain photographic light-sensitive materials.

Each light-sensitive material was exposed through an optical wedge for 5 seconds using a sensitometer having a light source of 5,400° K. color temperature (64 lx) fitted with a yellow filter (SC-46, made by Fuji Photo Film Co., Ltd.).

Each sample was developed at 20° C. for 2 minutes using a developer of the following formulation, then subjected to a stopping step, a fixing step, and a water washing step to obtain strips having a predetermined black-and-white image. The sensitivities are given in Tables 3 to 5 as relative values taking [fog+1.5] as a base optical density for determining sensitivity. It can be seen from Tables 3 to 5 that the supersensitizing agents of the present invention provide a remarkable supersensitizing effect.

| Formulation of Developer: | |
|---|---|
| Water | 700 ml |
| Metol | 3.1 g |
| Anhydrous Sodium Sulfite | 45 g |
| Hydroquinone | 12 g |
| Sodium Carbonate (monohydrate) | 79 g |
| Potassium Bromide | 1.9 g |
| Water to make | 1 liter |

Two parts of water was added to one part of this developer for use.

TABLE 3

| No. | Sensitizing Dye ($\times 10^{-5}$ mol/kg emulsion) | Supersensitizing Agent ($\times 10^{-5}$ mol/kg emulsion) | Spectral Sensitivity ($S_Y$) | Fog Density | Note |
|---|---|---|---|---|---|
| 1 | Compound VII-22 (8) | — | 100 (base) | 0.04 | Comparison |
| 2 | Compound VII-22 (8) | Compound 1 (8) | 1,260 | 0.04 | Invention |

TABLE 4

| No. | Sensitizing Dye ($\times 10^{-5}$ mol/kg emulsion) | Supersensitizing Agent ($\times 10^{-5}$ mol/kg emulsion) | Spectral Sensitivity ($S_Y$) | Fog Density | Note |
|---|---|---|---|---|---|
| 1 | Compound II-14 (16) | — | 100 (base) | 0.05 | Comparison |
| 2 | Compound II-14 (16) | Compound 16 (16) | 234 | 0.05 | Invention |

TABLE 5

| No. | Sensitizing Dye ($\times 10^{-5}$ mol/kg emulsion) | Supersensitizing Agent ($\times 10^{-5}$ mol/kg emulsion) | Spectral Sensitivity ($S_Y$) | Fog Density | Note |
|---|---|---|---|---|---|
| 1 | Compound VII-7 (16) | — | 100 (base) | 0.05 | Comparison |
| 2 | Compound VII-7 (16) | Compound 1 (4.8) | 269 | 0.05 | Invention |
| 3 | Compound VII-7 (16) | Compound 16 (16) | 251 | 0.05 | Invention |

EXAMPLE 4

On a polyethylene terephthalate transparent support were coated, in sequence, the following layers (1) to (6) to prepare color direct positive diffusion transfer Light-Sensitive Sheet a.

(1) A mordant layer (image-receiving layer) containing the following copolymer (3.0 g/m$^2$) and gelatin (3.0 g/m$^2$):

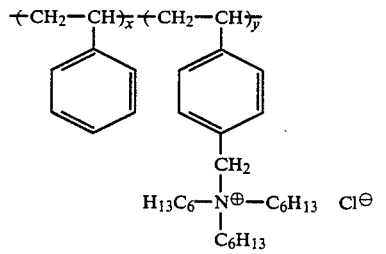

x:y = 50:50

(2) A white reflecting layer containing titanium oxide (18.0 g/m$^2$) and gelatin (2.0 g/m$^2$).

(3) A black, light barrier layer containing carbon black (2.0 g/m$^2$) and gelatin (1.0 g/m$^2$).

(4) A magenta color material layer containing magenta dye-releasing redox compounds of the following structural formulae I and II (0.21 g/m$^2$ and 0.11 g/m$^2$, respectively), tricyclohexyl phosphate (0.08 g/m$^2$), 2,5-di-tert-pentadecylhydroquinone (0.01 g/m$^2$), and gelatin (0.9 g/m$^2$).

Structural Formula I:

-continued

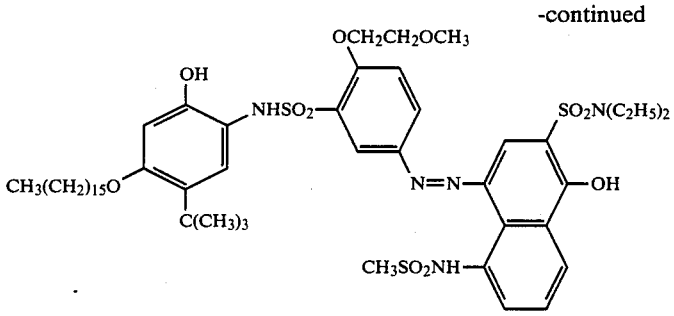

Structural Formula II:

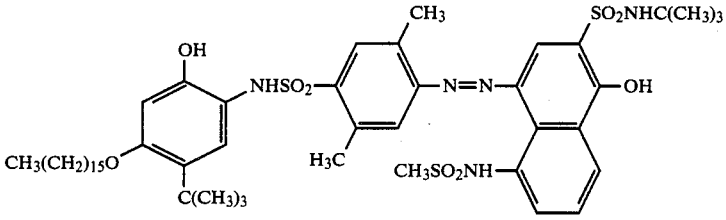

(5) A green-sensitive direct positive emulsion layer containing internal latent image-forming direct positive silver bromoiodide (iodide content: 2 mol%) of monodisperse octahedral grains of 1.5 μm in mean edge length sensitized with Cyanine Dye II-1 (2.8 mg/g Ag) (1.40 g Ag/m$^2$), gelatin (1.1 g/m$^2$), sodium 5-n-pentadecylhydroquinone-2-sulfonate (0.01 g/m$^2$), and the following nucleating agent (0.005 mg/m$^2$):

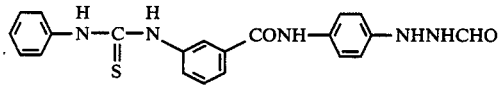

(6) A protective layer containing the following UV ray absorbent (0.20 g/m$^2$), triacryloyltriazine (0.02 g/m$^2$, hardener), and gelatin (0.3 g/m$^2$).

UV Ray Absorbent:

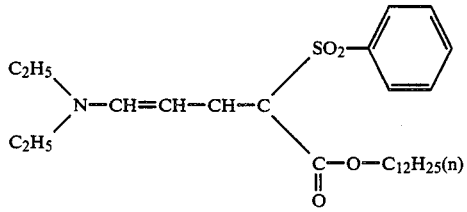

Light-Sensitive Material Sheets b to g were prepared by adding the illustrative compounds of the present invention (supersensitizing agents) (1), (15), (41), (43), (44) and (61), respectively, to emulsion layer (5) of the above-described multilayered film in amounts given in Table 6.

The above-described color positive Light-Sensitive Material Sheets a to g were exposed and developed using the following processing solution and the following cover sheet in combination.

| Formulation of the Processing Solution: | |
|---|---|
| 1-p-Tolyl-4-methyl-4-hydroxymethyl-3-pyrazolidone | 10.0 g |

-continued

| Formulation of the Processing Solution: | |
|---|---|
| tert-Butylhydroquinone | 0.2 g |
| 5-Methylbenzotriazole | 3.5 g |
| Benzyl Alcohol | 2.0 g |
| Sodium Sulfite (anhydrous) | 2.0 g |
| Carboxymethyl Cellulose Na Salt | 60 g |
| Carbon Black Dispersion (C content: 25%) | 600 g |
| Potassium Hydroxide | 56 g |
| Water to make | 1 kg |

Cover Sheet:

A cover sheet was prepared by coating on a polyethylene terephthalate support first a polyacrylic acid (viscosity as a 10 wt% aqueous solution: about 1,000 cps) (15 g/m$^2$) as an acidic polymer neutralizing layer, and then acetyl cellulose (hydrolysis of 100 g of this cellulose yielding 39.4 g of acetyl group) (3.8 g/m$^2$) and styrene/maleic anhydride copolymer (molar ratio of styrene/maleic anhydride about 60:40, molecular weight about 50,000) (0.2 g/m$^2$) as a neutralization timing layer.

Exposure and Processing Steps:

The above-described cover sheet was superimposed on each of the aforesaid Light-Sensitive Sheets a to g, and a pressure-rupturable pod containing 0.8 g of the processing solution was inserted at one end of the sheet. Each of the thus-obtained light-sensitive units was exposed through a continuous wedge from the cover sheet side for 1/20 second using a tungsten lamp as a light source, then the units were passed between parallel pressure-applying rollers to rapidly spread the processing solution in a solution thickness of 100 μm.

The color density of the reversal positive image appearing on the image-receiving layer was measured using a Macbeth reflection densitometer, and relative sensitivity, maximum density, and minimum density of each positive image were determined from the resulting characteristic curve. The results are tabulated in Table 6.

As is clear from the results, Light-Sensitive Materials b to g containing the supersensitizing agents of the present invention showed improved sensitivity of positive image, while maintaining good maximum density and minimum density levels. Thus, the supersensitizing agents of the present invention are demonstrated to have an excellent supersensitizing effect when used in direct positive light-sensitive materials.

TABLE 6

| Light-Sensitive Material | Illustrative Supersensitizing Compound | Amount Added (mg/g Ag) | Maximum Sensitivity | Minimum Sensitivity | Relative Sensitivity* | Note |
|---|---|---|---|---|---|---|
| a | — | — | 2.2 | 0.24 | 100 | Comparison |
| b | 1 | 0.26 | 2.0 | 0.24 | 130 | Invention |
| c | 15 | 0.52 | 2.1 | 0.22 | 110 | Invention |
| d | 41 | 0.16 | 2.1 | 0.24 | 110 | Invention |
| e | 43 | 0.26 | 2.1 | 0.24 | 130 | Invention |
| f | 44 | 0.26 | 2.1 | 0.23 | 126 | Invention |
| g | 61 | 0.52 | 2.2 | 0.22 | 112 | Invention |

*Relative values of reciprocals of exposure required to give a density of (maximum density + minimum density) × ½

While the invention has been described in detail and with reference to specific embodiments thereof, it will be apparent to one skilled in the art that various changes and modifications can be made therein without departing from the spirit and scope thereof.

What is claimed is:

1. A silver halide photographic light-sensitive material comprising a support having provided thereon at least one silver halide emulsion layer, said light-sensitive material containing at least one spectral sensitizing dye and at least one electron-donative, silver halide adsorptive compound represented by the following general formula (A) or (B) which is not a spectral sensitizing agent for silver halide or a nucleating agent:

D—L—X (A)

D—X (B)

wherein D represents an electron-donative atomic group comprising an aromatic ring or hetero ring which may be unsubstituted or substituted with at least one substituent; L represents a linkage group containing at least one of C, N, S or O; and X represents a silver halide-adsorptive group containing at least one of C, N, S, O, or Se.

2. The light-sensitive material as claimed in claim 1, wherein D is a 5- or 6-membered single ring system or a fused ring system thereof.

3. The light-sensitive material as claimed in claim 1, wherein D is a hetero ring containing at least one of N, O, S and Se as a hetero atom.

4. The light-sensitive material as claimed in claim 1, wherein D is an aromatic ring or a hetero ring derived from a metal salt or a metal complex.

5. The light-sensitive material as claimed in claim 1, wherein D is a group derived from a compound having the following skeleton:

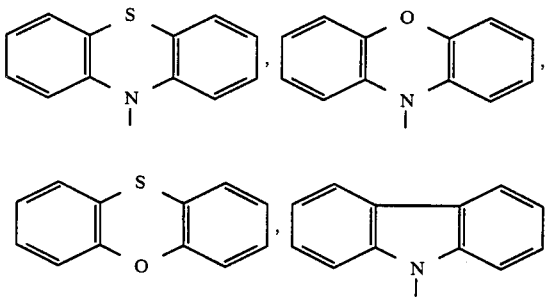

-continued

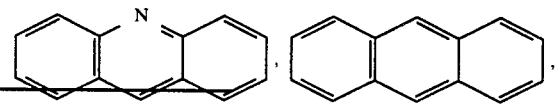

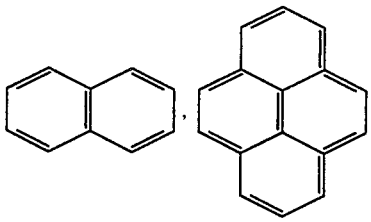

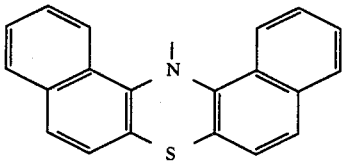

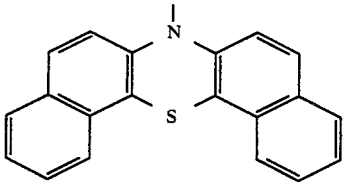

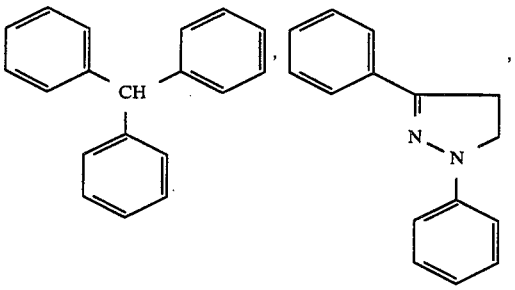

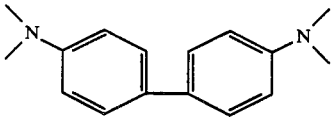

-continued

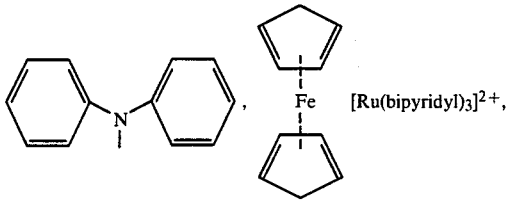

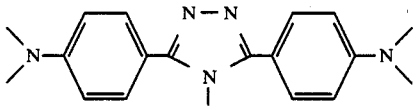

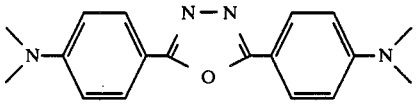

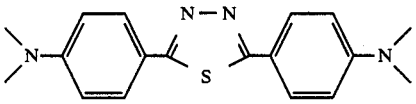

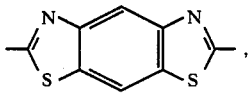

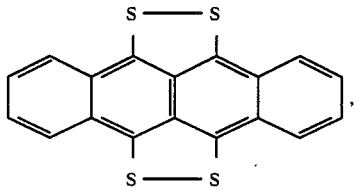

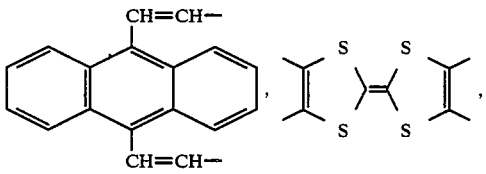

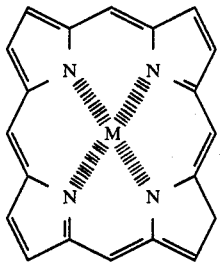

(In the above formula, M represents a transition metal).

6. The light-sensitive material as claimed in claim 1, wherein D is a group derived from phenothiazine, phenoxazine, carbazole or dibenzophenothiazine, which may be substituted by an amino group, an alkoxy group, a hydroxy group, an alkyl group, an aryl group, an aryloxy group, an alkylthio group, an arylthio group, a halogen atom, an acylamino group, an acyloxy group, a sulfonylamino group, a carbamoyl group, a sulfamoyl group, an alkoxycarbonyl group, a ureido group or a cyano group.

7. The light-sensitive material as claimed in claim 1, wherein L is selected from the group consisting of an alkylene group, an alkenylene group, an arylene group, a divalent group derived from hetero ring, —O—, —S—, —CO—, —$SO_2$—, —NH— and —N=, either alone or in combination.

8. The light-sensitive material as claimed in claim 1, wherein X is a group derived from thiourea, selenourea, thioamide, thiosemicarbazide, benzotriazole, rhodanine, thiohydantoin, thiobarbituric acid, or a mercapto-substituted hetero ring group compound, or a mercapto group.

9. The light-sensitive material as claimed in claim 8, wherein X is a group represented by the following general formula:

$$-NR_1\underset{\underset{S}{\|}}{C}NR_2R_3$$

wherein $R_1$, $R_2$ and $R_3$, which may be the same or different, each represents an alkyl group, an aryl group, or a 5-, 6- or 7-membered hetero ring group, with at least one of $R_1$, $R_2$ and $R_3$ being a hydrogen atom.

10. The light-sensitive material as claimed in claim 8, wherein the mercapto-substituted hetero ring compound is selected from the group consisting of mercaptotetrazole, mercaptotriazole, mercaptooxazole, mercaptothiazole, mercaptothiadiazole, mercaptoimidazole, mercaptobenzothiazole, mercaptobenzoxazole, mercaptopyrimidine and mercaptotriazine.

11. The light-sensitive material as claimed in claim 1, wherein the compound of general formula (A) or (B) or the electron-donative aromatic group represented by D has an oxidation potential of from about 0 to 1.0 V with respect to a saturated calomel electrode.

12. The light-sensitive material as claimed in claim 1, wherein said electron-donative compound is present in an amount from about $10^{-6}$ to $10^{-2}$ mol per mol of silver halide in said emulsion layer.

13. The light-sensitive material as claimed in claim 12, wherein said electron-donative compound is present in an amount from about $10^{-5}$ to $10^{-3}$ mol per mol of silver halide in said emulsion layer.

14. The light-sensitive material as claimed in claim 1, wherein said spectral sensitizing dye is selected from the group consisting of cyanine dyes, merocyanine dyes, complex cyanine dyes, complex merocyanine dyes, holopolar cyanine dyes, styryl dyes, hemicyanine dyes, oxonol dyes and hemioxonol dyes.

15. The light-sensitive material as claimed in claim 14, wherein said cyanine dye is represented by the following general formula (I):

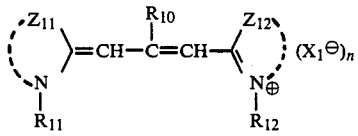

(I)

wherein $Z_{11}$ and $Z_{12}$, which may be the same or different, each represents a non-metallic atomic group necessary to complete a benzothiazole nucleus, a naphthoselenazole nucleus, a benzoselenazole nucleus, a naphthothiazole nucleus, a thiazole nucleus or a thiazoline nucleus; $R_{11}$ and $R_{12}$ each represents an alkyl group; $R_{10}$ represents a hydrogen atom, an alkyl group or an aryl group; $X_1\ominus$ represents an acid anion; and n represents 0 or 1.

16. The light-sensitive material as claimed in claim 14, wherein said cyanine dye is represented by the following general formula (II):

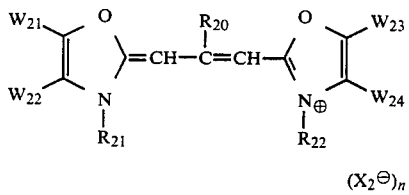

(II)

wherein $W_{21}$, $W_{22}$, $W_{23}$ and $W_{24}$, which may be the same or different, each represents a hydrogen atom, an alkyl group or an aryl group, provided that $W_{21}$ and $W_{22}$, or $W_{23}$ and $W_{24}$ or both $W_{21}$ and $W_{22}$, and $W_{23}$ and $W_{24}$ may combine to form an optionally substituted benzene ring or an optionally substituted naphthalene ring; $R_{21}$ and $R_{22}$, which may be the same or different, each represents an alkyl group; $R_{20}$ represents a hydrogen atom, an alkyl group or an aryl group; $X_2\ominus$ represents an acid anion; and n represents 0 or 1.

17. The light-sensitive material as claimed in claim 4, wherein said cyanine dye is represented by the following general formula (III):

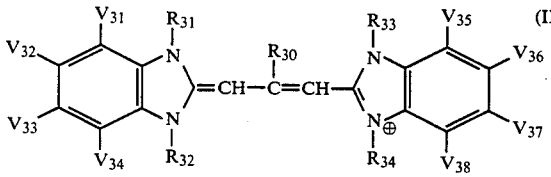

(III)

wherein $V_{31}$ to $V_{38}$, which may be the same or different, each represents a hydrogen atom, a halogen atom, a trifluoromethyl group, a cyano group, a carboxyl group, an alkoxycarbonyl group, a sulfamoyl group, a sulfonyl group, or a carbamoyl group, and any of $V_{31}$ and $V_{32}$, $V_{32}$ and $V_{33}$, $V_{33}$ and $V_{34}$, $V_{35}$ and $V_{36}$, $V_{36}$ and $V_{37}$, or $V_{37}$ and $V_{38}$ may combine to form a carbon ring including a substituted or unsubstituted benzene ring; $R_{31}$ to $R_{34}$, which may be the same or different, each represents an alkyl group or a substituted alkyl group; $R_{30}$ represents a hydrogen atom, an alkyl group or an aryl group; $X_3\ominus$ represents an acid anion; and n represents 0 or 1.

18. The light-sensitive material as claimed in claim 14, wherein said cyanine dye is represented by the following general formula (IV):

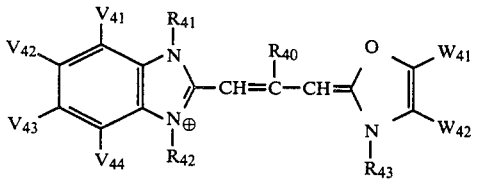

(IV)

wherein $V_{41}$ to $V_{44}$, which may be the same or different, each represents a hydrogen atom, a halogen atom, a trifluoromethyl group, a cyano group, a carboxyl group, an alkoxycarbonyl group, a sulfamoyl group, a sulfonyl group, or a carbamoyl group, and any of $V_{41}$ and $V_{42}$, $V_{42}$ and $V_{43}$, and $V_{43}$ and $V_{44}$, may combine to form a carbon ring including a substituted or unsubstituted benzene ring; $R_{41}$ and $R_{42}$, which may be the same or different, each represents an alkyl group or a substituted alkyl group; $W_{41}$ and $W_{42}$, which may be the same or different, each represents a hydrogen atom, an alkyl group or an aryl group, provided that $W_{41}$ and $W_{42}$ may combine to form an optionally substituted benzene ring or an optionally substituted naphthalene ring; $R_{43}$ represents an alkyl group; $R_{40}$ represents a hydrogen atom, an alkyl group or an aryl group; $X_4\ominus$ represents an acid anion; and n represents 0 or 1.

19. The light-sensitive material as claimed in claim 14, wherein said cyanine dye is represented by the following general formula (V):

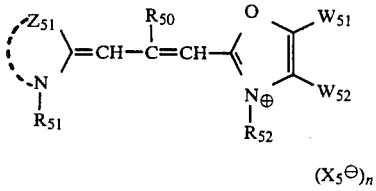

(V)

wherein $Z_{51}$ represents a non-metallic atomic group necessary to complete a benzothiazole nucleus, a naphthothiazole nucleus, a benzoselenazole nucleus, a naphthoselenazole nucleus, a thiazole nucleus or a thiazoline nucleus; $R_{51}$ and $R_{52}$ each represents an alkyl group; $R_{50}$ represents a hydrogen atom, an alkyl group or an aryl group; $W_{51}$ and $W_{52}$, which may be the same or different, each represents a hydrogen atom, an alkyl group or an aryl group, provided that $W_{51}$ and $W_{52}$ may combine to form an optionally substituted benzene ring or an optionally substituted naphthalene ring; $X_5\ominus$ represents an acid anion; and n represents 0 or 1.

20. The light-sensitive material as claimed in claim 14, wherein said cyanine dye is represented by the following general formula (VI):

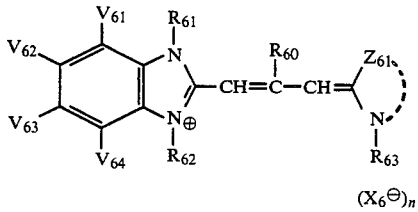

(VI)

wherein $V_{61}$ to $V_{64}$, which may be the same or different, each represents a hydrogen atom, a halogen atom, a trifluoromethyl group, a cyano group, a carboxyl group, an alkoxycarbonyl group, a sulfamoyl group, a sulfonyl group, or a carbamoyl group, and any of $V_{61}$ and $V_{62}$, $V_{62}$ and $V_{63}$, and $V_{63}$ and $V_{64}$ may combine to form a carbon ring including a substituted or unsubstituted benzene ring; $R_{61}$ and $R_{62}$, which may be the same or different, each represents an alkyl group or a substituted alkyl group; $Z_{61}$ represents a non-metallic atomic group necessary to complete a benzothiazole nucleus, a naphthothiazole nucleus, a benzoselenazole nucleus, a naphthoselenazole nucleus, a thiazole nucleus or a thiazoline nucleus, or $Z_{61}$ further represents a non-metallic atomic group necessary for completing an indoline nucleus; $R_{63}$ represents an alkyl group; $R_{60}$ represents a hydrogen atom, an alkyl group or an aryl group; $X_6^{31}$ represents an acid anion; and n represents 0 or 1.

21. The light-sensitive material as claimed in claim 14, wherein said cyanine dye is represented by the following general formula (VII):

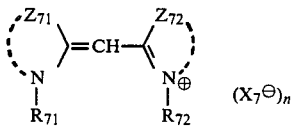

(VII)

wherein $Z_{71}$ and $Z_{72}$, which may be the same or different, each represents a non-metallic atomic group necessary for completing a benzoxazole nucleus, a benzothiazole nucleus, a benzoselenazole nucleus, a naphthoxazole nucleus, a naphthothiazole nucleus, a naphthoselenazole nucleus, a thiazole nucleus, a thiazoline nucleus, an oxazole nucleus, a selenazole nucleus, a selenazoline nucleus, a pyridine nucleus or a quinoline nucleus $R_{71}$ and $R_{72}$, which may be the same or different, each represents an alkyl group; $X_7^-$ represents an acid anion; and n represents 0 or 1.

22. The light-sensitive material as claimed in claim 14, wherein said cyanine dye is represented by the following general formula (VIII):

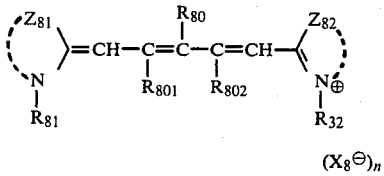

(VIII)

wherein $Z_{81}$ and $Z_{82}$, which may be the same or different, each represents a non-metallic atomic group necessary for completing a pyridine nucleus, a quinoline nucleus, a benzothiazole nucleus, a naphthothiazole nucleus, a benzoxazole nucleus, a benzoselenazole nucleus, a naphthoxazole nucleus, a naphthoselenazole nucleus, a thiazole nucleus or a thiazoline nucleus; $R_{81}$ and $R_{82}$, which may be the same or different, each represents an alkyl group, $R_{80}$, $R_{801}$ and $R_{802}$, which may be the same or different, each represents a hydrogen atom, an alkyl group or a halogen atom, provided that $R_{801}$ and $R_{802}$ may combine to form a ring; $X_8^-$ represents an acid anion; and n represents 0 or 1.

23. The light-sensitive material as claimed in claim 1, wherein said spectral sensitizing dye is present in an amount from about $1.0\times10^{-5}$ to $1.0\times10^{-3}$ mol per mol of silver halide.

24. The light-sensitive material as claimed in claim 23, wherein said spectral sensitizing dye is present in an amount from about $4.0\times10^{-5}$ to $2\times10^{-4}$ mol per mol of silver halide.

25. The light-sensitive material as claimed in claim 1, wherein the ratio of said spectral sensitizing dye to said electron-donative compound is from about 1:10 to 10:1 by mol.

26. The light-sensitive material as claimed in claim 1, wherein said electron-donative compound is present in a hydrophilic colloidal layer adjacent to said silver halide emulsion layer.

27. The light-sensitive material as claimed in claim 1, wherein said electron-donative compound and said spectral sensitizing dye are present in said silver halide emulsion layer.

28. The light-sensitive material as claimed in claim 1, wherein said N contained in said silver halide-adsorptive group X is quaternized.

* * * * *